US010775135B1

(12) United States Patent
Knupple, Jr.

(10) Patent No.: US 10,775,135 B1
(45) Date of Patent: Sep. 15, 2020

(54) KIT FOR FACILITATING ALIGNING OF TWIST-IN SCOPE RINGS OF FIREARMS

(71) Applicant: David Earl Knupple, Jr., Silsbee, TX (US)

(72) Inventor: David Earl Knupple, Jr., Silsbee, TX (US)

( * ) Notice: Subject to any disclaimer, the term of this patent is extended or adjusted under 35 U.S.C. 154(b) by 0 days.

(21) Appl. No.: 16/802,169

(22) Filed: Feb. 26, 2020

Related U.S. Application Data

(60) Provisional application No. 62/810,825, filed on Feb. 26, 2019.

(51) Int. Cl.

| | |
|---|---|
| ***F41G 1/54*** | (2006.01) |
| ***F41G 1/44*** | (2006.01) |
| *F41G 1/387* | (2006.01) |
| *F41G 1/16* | (2006.01) |

(52) U.S. Cl.
CPC ..... *F41G 1/54* (2013.01); *F41G 1/44* (2013.01); *F41G 1/16* (2013.01); *F41G 1/387* (2013.01)

(58) Field of Classification Search
CPC ..... F41G 1/545; F41G 1/54
USPC ..... 42/116, 121, 134
See application file for complete search history.

(56) References Cited

U.S. PATENT DOCUMENTS

| | | | | |
|---|---|---|---|---|
| 3,112,567 A * | 12/1963 | Flanagan | ..... | F41G 1/54 42/121 |
| 3,908,282 A * | 9/1975 | Steffan | ..... | F41G 1/54 42/121 |
| 4,095,347 A * | 6/1978 | Steffan | ..... | F41G 1/38 33/295 |
| D852,310 S | 6/2019 | Knupple, Jr. | | |

* cited by examiner

*Primary Examiner* — Reginald S Tillman, Jr.

(57) ABSTRACT

Disclosed herein is a kit for facilitating aligning of twist-in scope rings of firearms. Accordingly, the kit may include a centering component, and a laser pointer. Further, the centering component may be for providing a reference for aligning a twist-in scope ring with a bore of a firearm. Further, the twist-in scope ring may be coupled to a barrel of the firearm. Further, the twist-in scope ring may be rotatable around a scope axis. Further, the centering component may include a primary elongated member and a secondary elongated member attached to the primary elongated member. Further, the laser pointer may be detachably couplable with the twist-in scope ring. Further, the laser pointer may include a laser pointer body configured to be inserted in the twist-in scope ring. Further, the laser pointer may be configured for emitting a laser beam.

20 Claims, 24 Drawing Sheets

KIT FOR FACILITATING ALIGNING OF TWIST-IN SCOPE RINGS OF FIREARMS

The current application claims a priority to the U.S. Provisional Patent application Ser. No. 62/810,825 filed on Feb. 26, 2019.

FIELD OF THE INVENTION

Generally, the present disclosure relates to the field of firearms. More specifically, the present disclosure relates to a kit for facilitating aligning of twist-in scope rings of firearms.

BACKGROUND OF THE INVENTION

Proper scope alignment is important in long-distance shooting. If a scope ring is misaligned by a few degrees, the scope ring is not concentric to the bore of a firearm. Currently used methods for scope alignment include bore-sighting. However, the bore-sighting only aligns the scope with the barrel of the firearm and not the bore of the firearm. If the bore-sighting is used on a firearm has a bore that is not centered in the barrel, the scope ring will not be aligned with the bore of the firearm. With the scope ring misaligned, the scope when attached do not provide the accuracy required for long-distance shooting.

Therefore, there is a need for an improved kit for facilitating aligning of twist-in scope rings of firearms that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is a kit for facilitating aligning of twist-in scope rings of firearms, in accordance with some embodiments. Accordingly, the kit may include a centering component, and a laser pointer. Further, the centering component may be for providing a reference for aligning a twist-in scope ring with a bore of a firearm. Further, the twist-in scope ring may be coupled to a barrel of the firearm. Further, the twist-in scope ring may be rotatable around a scope axis. Further, the centering component may include a primary elongated member and a secondary elongated member attached to the primary elongated member. Further, a first portion of the primary elongated member may be attached to a second portion of the secondary elongated member. Further, a first longitudinal axis of the primary elongated member may be perpendicular to a second longitudinal axis of the secondary elongated member. Further, at least one end of the primary elongated member may be configured to be inserted into the bore. Further, the primary elongated member may be configured to rotate in relation to the bore allowing the secondary elongated member to be angularly displaced around a bore axis corresponding to the bore. Further, the laser pointer may be detachably couplable with the twist-in scope ring. Further, the laser pointer may include a laser pointer body configured to be inserted in the twist-in scope ring. Further, the laser pointer may be configured for emitting a laser beam.

Further disclosed herein is a kit for facilitating aligning of twist-in scope rings of firearms, in accordance with some embodiments. Accordingly, the kit may include a centering component, and a laser pointer. Further, the centering component may be for providing a reference for aligning a twist-in scope ring with a bore of a firearm. Further, the twist-in scope ring may be coupled to a barrel of the firearm. Further, the twist-in scope ring may be rotatable around a scope axis. Further, the centering component may include a primary elongated member and a secondary elongated member attached to the primary elongated member. Further, a first portion of the primary elongated member may be attached to a second portion of the secondary elongated member. Further, a first longitudinal axis of the primary elongated member may be perpendicular to a second longitudinal axis of the secondary elongated member. Further, at least one end of the primary elongated member may be configured to be inserted into the bore. Further, the primary elongated member may be configured to rotate in relation to the bore allowing the secondary elongated member to be angularly displaced around a bore axis corresponding to the bore. Further, the laser pointer may be detachably couplable with the twist-in scope ring. Further, the laser pointer may be configured for emitting a laser beam. Further, the laser pointer may include a laser pointer body configured to be inserted in the twist-in scope ring. Further, the laser pointer body characterized by a pointer circumference and a pointer length. Further, the pointer circumference may be equal to an inner scope ring circumference restricting lateral movement of the laser pointer in relation to a scope ring axis of the twist-in scope ring.

Further disclosed herein is a kit for facilitating aligning of twist-in scope rings of firearms, in accordance with some embodiments. Accordingly, the kit may include a centering component, an arbor, a laser barrel, and a laser pointer. Further, the centering component may be for providing a reference for aligning a twist-in scope ring with a bore of a firearm. Further, the twist-in scope ring may be coupled to a barrel of the firearm. Further, the twist-in scope ring may be rotatable around a scope axis. Further, the centering component may include a centering rod, a ring, and a fastener. Further, the centering rod may include a rod elongated member. Further, the rod elongated member may include an imprinted surface. Further, the ring may include an annular member extending between an outer periphery and an inner periphery forming a ring cavity. Further, a first rod end of the rod elongated member may be attached to the annular body on the outer periphery. Further, the ring may include a threaded cavity disposed on the annular member. Further, the fastener may include a threaded member and a knob disposed on a first fastener end of the threaded member. Further, the threaded member may be threadedly coupled with the threaded cavity. Further, the arbor may be detachably coupled with the centering component. Further, the arbor may include an arbor elongated member. Further, the ring cavity may be configured for receiving the arbor elongated member. Further, an arbor longitudinal axis of the arbor elongated member may be perpendicular to a rod longitudinal axis of the rod elongated member. Further, at least on end of the arbor elongated member may be configured to be inserted in the bore. Further, the ring may be configured to rotate in relation to the bore allowing the centering rod to be angularly displaced around a bore axis corresponding to the bore. Further, the laser barrel may include a cylindrical member. Further, the twist-in scope ring of a ring circumference may be configured for encompassing the cylindrical member circumferentially. Further, the laser barrel may include a barrel cavity disposed in the cylindrical member. Further, the barrel cavity may be concentric with the cylindrical member. Further, the barrel cavity may include a cavity opening disposed on a circular surface of the cylindrical member. Further, the laser pointer may be disposed in the barrel cavity. Further, the laser pointer may be configured for emitting a laser beam.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION OF THE INVENTION

Figure 1:
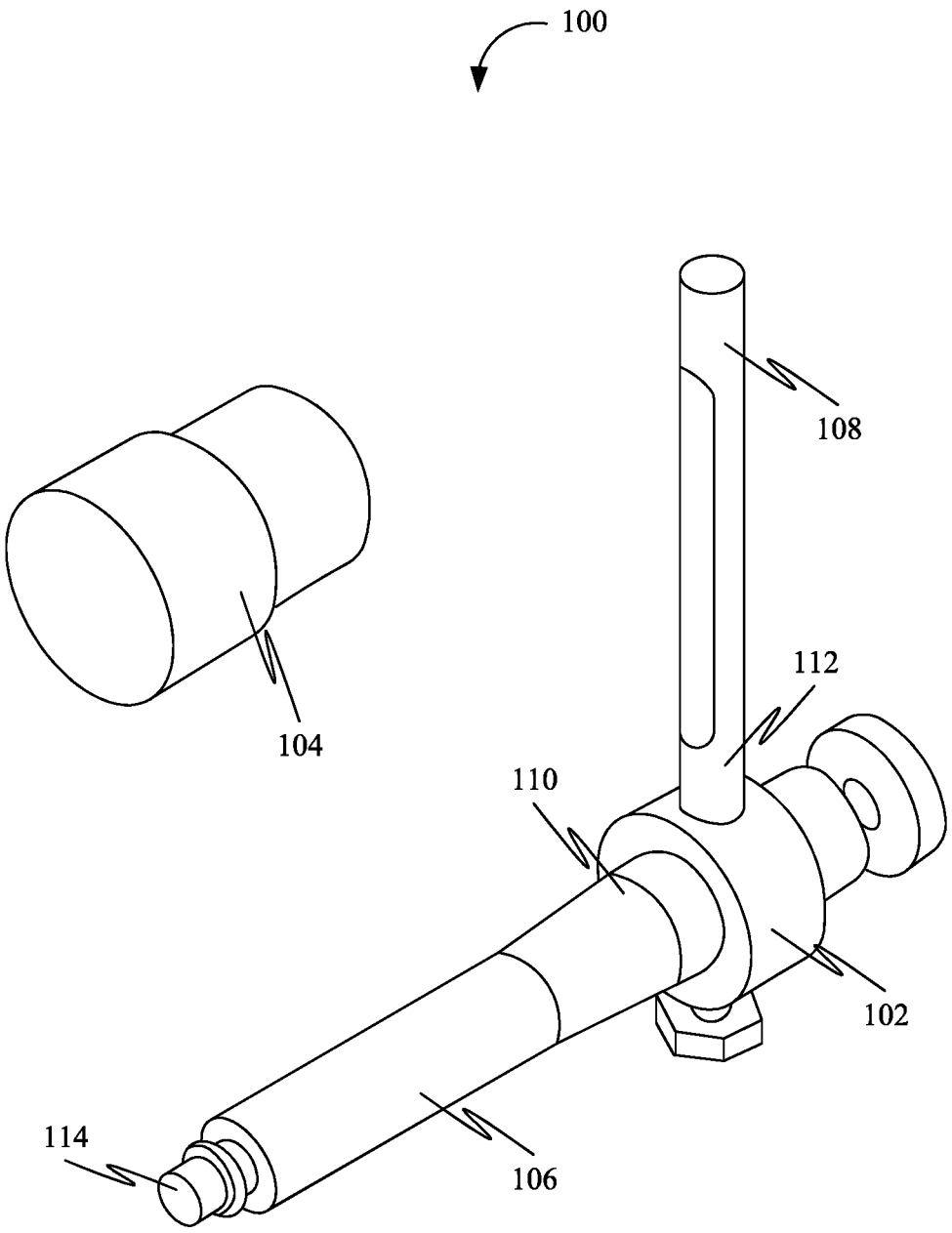
FIG. 1 is a perspective view of a kit for facilitating aligning of twist-in scope rings of firearms, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of a kit for facilitating aligning of twist-in scope rings of firearms, embodiments of the present disclosure are not limited to use only in this context.

Overview:

The present disclosure describes a kit for facilitating aligning of twist-in scope rings of firearms. Further, the twist-in scope rings are considered one of the most popular types of scope rings on the market. Further, the disclosed kit may be an assembly for aligning twist-in scope rings on a firearm. Further, the assembly may allow the scope ring to be aligned with a bore, ensuring the scope may be properly aligned when the scope is attached to the firearm. Further, the assembly may also align twist-in scope rings with the bore of the firearm.

Further, the present disclosure may be used to align (center) a front "twist in" scope ring with the center of a rifle bore, not the center of the barrel. Further, a standard rifle "twist in" scope ring may be either 1" or 30 mm in diameter. Further, the present disclosure may incorporate a small laser installed in the center of a laser body which is mounted in the front scope ring, either 1" or 30 mm in diameter. Further, a rifle must be leveled off of front scope base prior to installing front scope ring. Once the front ring is installed, the TDC "top dead center" located, is installed in the front ring and tightened down as normal. This is the first step next, a bore arbor "caliber-specific" may be installed in the bore of the rifle. The locating rod may be installed on the arbor pointing up. The locator is then "plumbed" with a 90 deg. Leveled to be sure it is at a right angle to the front base, for the front "twist in" ring. Next, turn on the laser. Carefully turn scope ring until the light from the laser is dead center of locating rod. The front ring mounting is now complete. Remove the TDC locator. Rifle scopes front ring is now true and ready to complete scope mounting.

Further, the present disclosure may be an assembly for aligning twist-in scope rings on a firearm. Further, the assembly allows for the precise alignment of the front twist-in scope ring. Further, the assembly may ensure that the front twist-in scope ring may be properly aligned with the bore. Further, the assembly comprises a centering component, a laser barrel, and an arbor.

Further, the centering component provides a target that may be used as a reference for the alignment of the front twist-in scope ring. The centering component comprises a centering rod, a ring, and a fastener. The centering rod is connected to the ring and provides a vertical axis to be used as a reference for the laser barrel. The vertical axis provided by the centering rod is perpendicular to the axis of the bore of the firearm. The centering rod comprises an imprinted surface. The imprinted surface is positioned on the exterior of the centering rod and is aligned with the longitudinal axis of the centering rod. The width of the imprinted surface is configured for a beam projected by a laser barrel. The width of the marking ensures the laser barrel is lined up with the longitudinal axis of the centering rod, ensuring the twist-in scope ring is aligned correctly with the bore of the firearm. In the preferred embodiment of the assembly, the imprinted surface is a continuous vertical marking. In other embodiments of the assembly, the imprinted surface may be a plurality of markings.

Further, the ring allows the centering component to be coupled with the arbor. In the preferred embodiment of the assembly, the hole in the ring has a smooth surface, allowing the ring to be slid onto the arbor. Continuing with the preferred embodiment, the ring can be rotated while coupled with the arbor allowing the centering rod to be aligned vertically in respect to the axis of the arbor. The ring comprises a socket. The socket allows the fastener to be attached to the ring. The fastener allows the ring to be fixed in place. In the preferred embodiment of the assembly, the fastener comprises a threaded member and a knob and the socket is a threaded hole. In other embodiments of the assembly, the fastener may be of a variety of means.

Further, the laser barrel is inserted into the front twist-in scope ring of a firearm and faces the barrel of the firearm. The laser barrel projects a beam of light from the front twist-in scope ring onto the imprinted surface. The diameter of the laser barrel varies across the length of the laser barrel, allowing the laser barrel to be inserted into a variety of twist-in scope rings (1" and 30 mm). The laser barrel comprises a laser. The laser is concentric to the laser barrel and projects a beam onto the imprinted surface.

Further, the arbor is inserted into the bore of the firearm and couples with the centering component. The arbor ensures that the centering component is aligned with the bore of the firearm.

Many gunsmiths and sportsmen alike take on the task of mounting their rifle scope. With the popular twist in rings like Leupold Redfield, Burris and Millet, etc. getting the front ring truly square to the centerline of the bore (not the barrel) has been a hit or miss undertaking. Many, do not know, that the front ring being as much as ½ deg. Off-center of the bore can cause centerline of the rifle scope to be as much as ½" off-center with a 24" barrel.

A TDC ring mounting/locating tool may remove all of the guesswork out of getting the front ring concentric to the bore of the rifle, squeezing all of the accuracy one can, with a mounting combination.

Further, the TDC ring mounting/locating tool may include laser w/ batteries, laser barrel (one piece for both 1" and 30 mm rings), arbors (.22 cal-.27 cal & 7 mm-.30 cal), and locator rod.

This is wow the TDC ring mounting/locator tool works—Make sure the firearm is unloaded. All the advantages of the tool are best utilized with the rifle barrel being held horizontally in a padded vise. Mount the bases for the twist in rings per manufactures instructions. Once the bases are secured to the firearm, level the front ring. Twist in the front ring and lineup as close to square to the action as possible. Install a top cap on the front ring. Do not tighten. Insert Laser Barrel in the front ring (according) to ring size 1" or 30 mm Attach the locator rod on the arbor (caliber specific). Insert arbor into bore of rifle and make sure the locator rod is straight up. A cross test level works well for this important step. Turn on a laser and insert it into the end of the laser barrel with laser pointing towards the locator rod. Carefully turn the front ring until the light from the laser is the center of the locating rod. Front ring alignment completed. Remove the ring alignment tools and complete the mounting process. The rifle scope is professionally mounted.

FIG. 1 is a perspective view of a kit 100 for facilitating aligning of twist-in scope rings of firearms, in accordance with some embodiments. Accordingly, the kit 100 may include a centering component 102, and a laser pointer 104.

Figure 8:
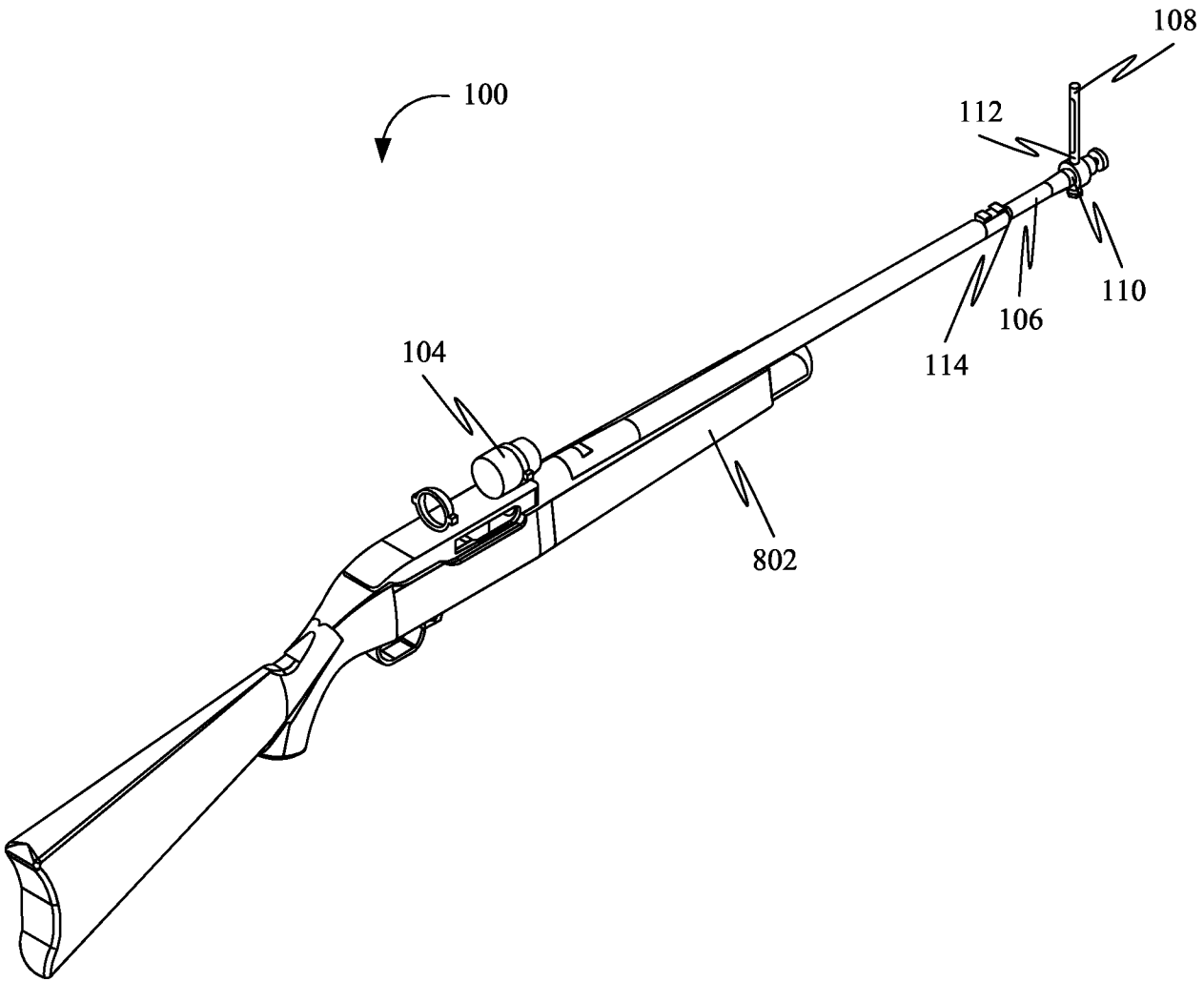
FIG. 8 is a perspective view of the kit being used on a firearm, in accordance with some embodiments.

Further, the centering component 102 may be for providing a reference for aligning a twist-in scope ring (not shown) with a bore of a firearm 802, as shown in FIG. 8. Further, the twist-in scope ring may be coupled to a barrel of the firearm 802. Further, the twist-in scope ring may be rotatable around a scope axis. Further, the centering component 102 may include a primary elongated member 106 and a secondary elongated member 108 attached to the primary elongated member 106. Further, a first portion 110 of the primary elongated member 106 may be attached to a second portion 112 of the secondary elongated member 108. Further, a first longitudinal axis of the primary elongated member 106 may be perpendicular to a second longitudinal axis of the secondary elongated member 108. Further, at least one end 114 of the primary elongated member 106 may be configured to be inserted into the bore. Further, the primary elongated member 106 may be configured to rotate in relation to the bore allowing the secondary elongated member 108 to be angularly displaced around a bore axis corresponding to the bore.

Further, the laser pointer 104 may be detachably couplable with the twist-in scope ring. Further, the laser pointer 104 may include a laser pointer body configured to be inserted in the twist-in scope ring. Further, the laser pointer 104 may be configured for emitting a laser beam.

Further, in some embodiments, the primary elongated member 106 may be characterized by a primary length and a primary circumference. Further, the primary circumference remains constant along the primary length. Further, an inner bore circumference of the bore may be equal to the primary circumference restricting lateral movement of the primary elongated member 106 in relation to the bore axis.

Further, in some embodiments, the primary elongated member 106 may be characterized by a primary member length and a primary member circumference. Further, the primary circumference progressively increases along the primary member length. Further, a primary circumference corresponding to a primary member length may be equal to an inner bore circumference of the bore restricting lateral movement of the primary elongated member 106 in relation to the bore axis.

Further, in some embodiments, the laser pointer 104 may include a laser pointer body characterized by a pointer circumference and a pointer length. Further, the pointer circumference remains constant along the pointer length. Further, the pointer circumference may be equal to an inner scope ring circumference restricting lateral movement of the laser pointer 104 in relation to a scope ring axis of the twist-in scope ring.

Further, in some embodiments, the laser pointer 104 may include a laser pointer body characterized by a pointer circumference and a pointer length. Further, the pointer circumference progressively decreases along the pointer length. Further, a pointer circumference corresponding to a pointer length may be equal to an inner scope ring circumference restricting lateral movement of the laser pointer 104 in relation to a scope ring axis of the twist-in scope ring.

Further, in some embodiments, the secondary elongated member 108 may be characterized by a secondary diameter. Further, the secondary diameter may be greater than a width of the laser beam.

Further, in some embodiments, the secondary elongated member 108 may include an imprinted surface. Further, the imprinted surface may be configured for reflecting the laser beam for viewing.

Further, in some embodiments, the laser pointer body may include a plurality of cylindrical members (not shown) corresponding to a plurality of twist-in scope rings (not shown) of the firearm 802. Further, each cylindrical member may be characterized by a pointer member circumference. Further, a first cylindrical member attached to a second cylindrical member concentrically. Further, a first pointer member circumference of the first cylindrical member may be equal to a first inner scope ring circumference of a first twist-in scope ring and a second pointer member circumference of the second cylindrical member may be equal to a second inner scope ring circumference of a second twist-in scope ring.

Further, in some embodiments, the centering component 102 may include an inclinometer (not shown). Further, the inclinometer may be disposed on a first end of the primary elongated member 106. Further, the inclinometer may be configured for determining a degree of rotation for the primary elongated member 106 in relation to the bore.

Figure 2:
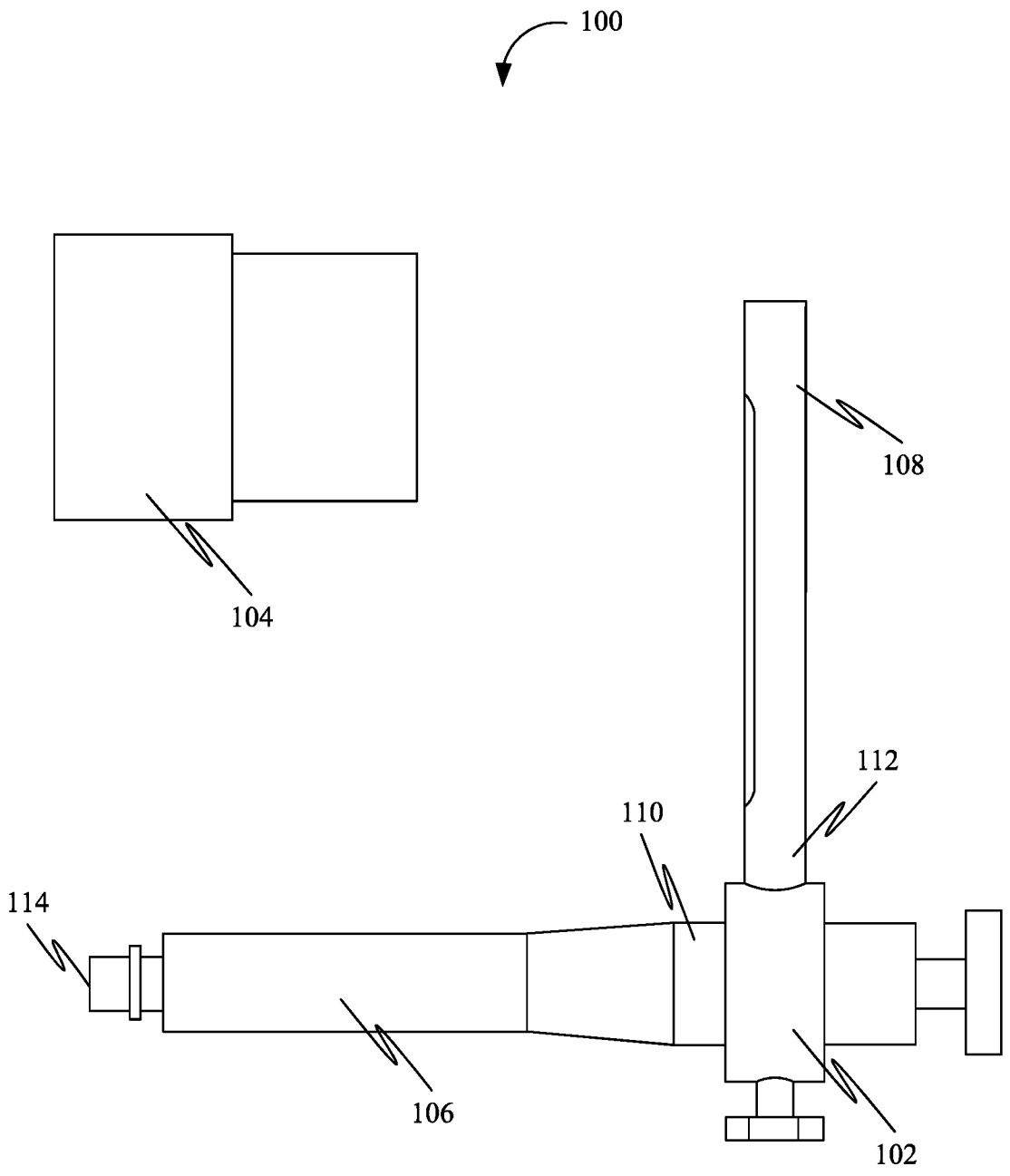
FIG. 2 is a left-side view of the kit for facilitating aligning of twist-in scope rings of firearms, in accordance with some embodiments.

FIG. 2 is a left-side view of the kit 100 for facilitating aligning of twist-in scope rings of firearms, in accordance with some embodiments.

Figure 3:
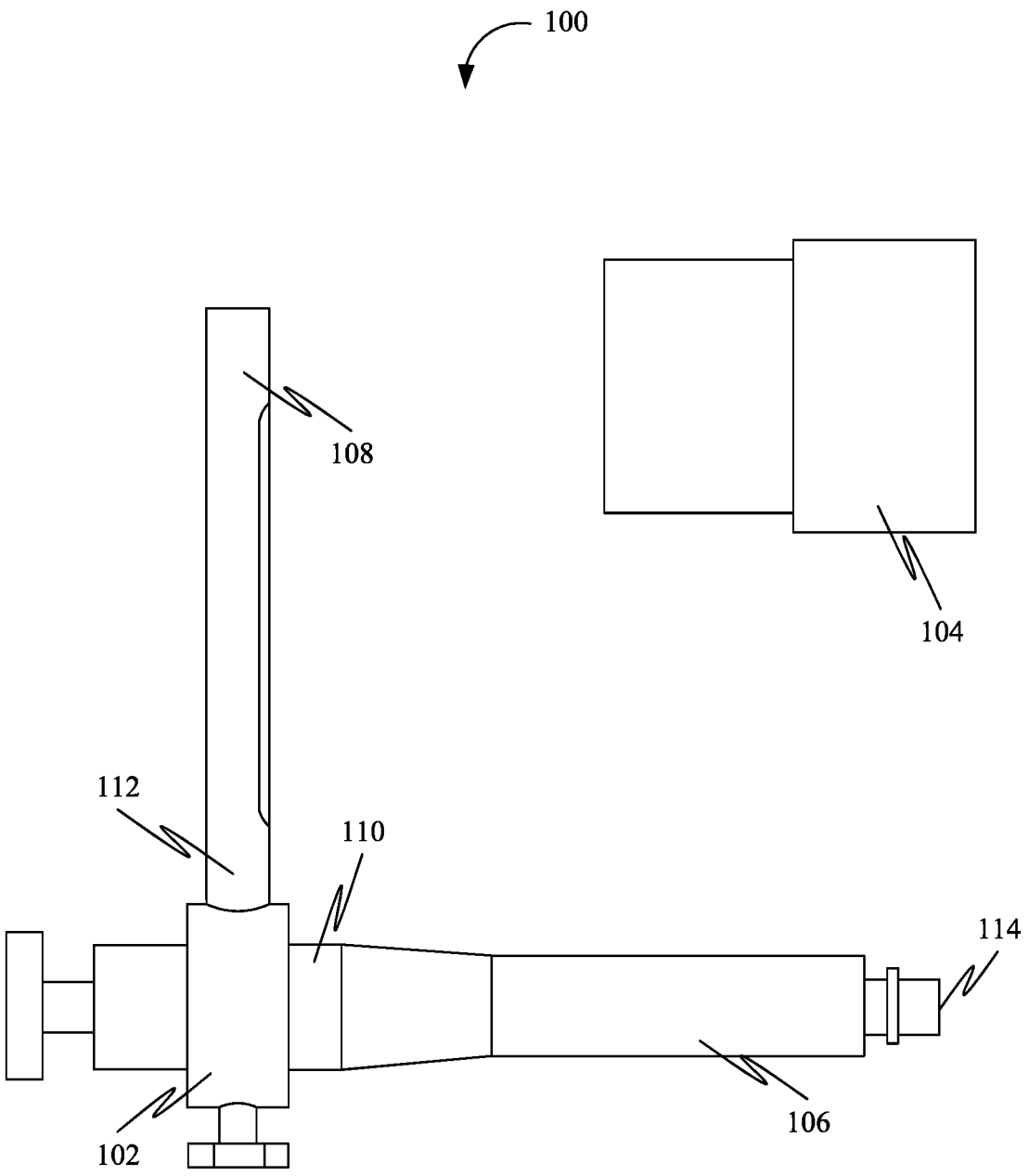
FIG. 3 is a right-side view of the kit for facilitating aligning of twist-in scope rings of firearms, in accordance with some embodiments.

FIG. 3 is a right-side view of the kit 100 for facilitating aligning of twist-in scope rings of firearms, in accordance with some embodiments.

Figure 4:
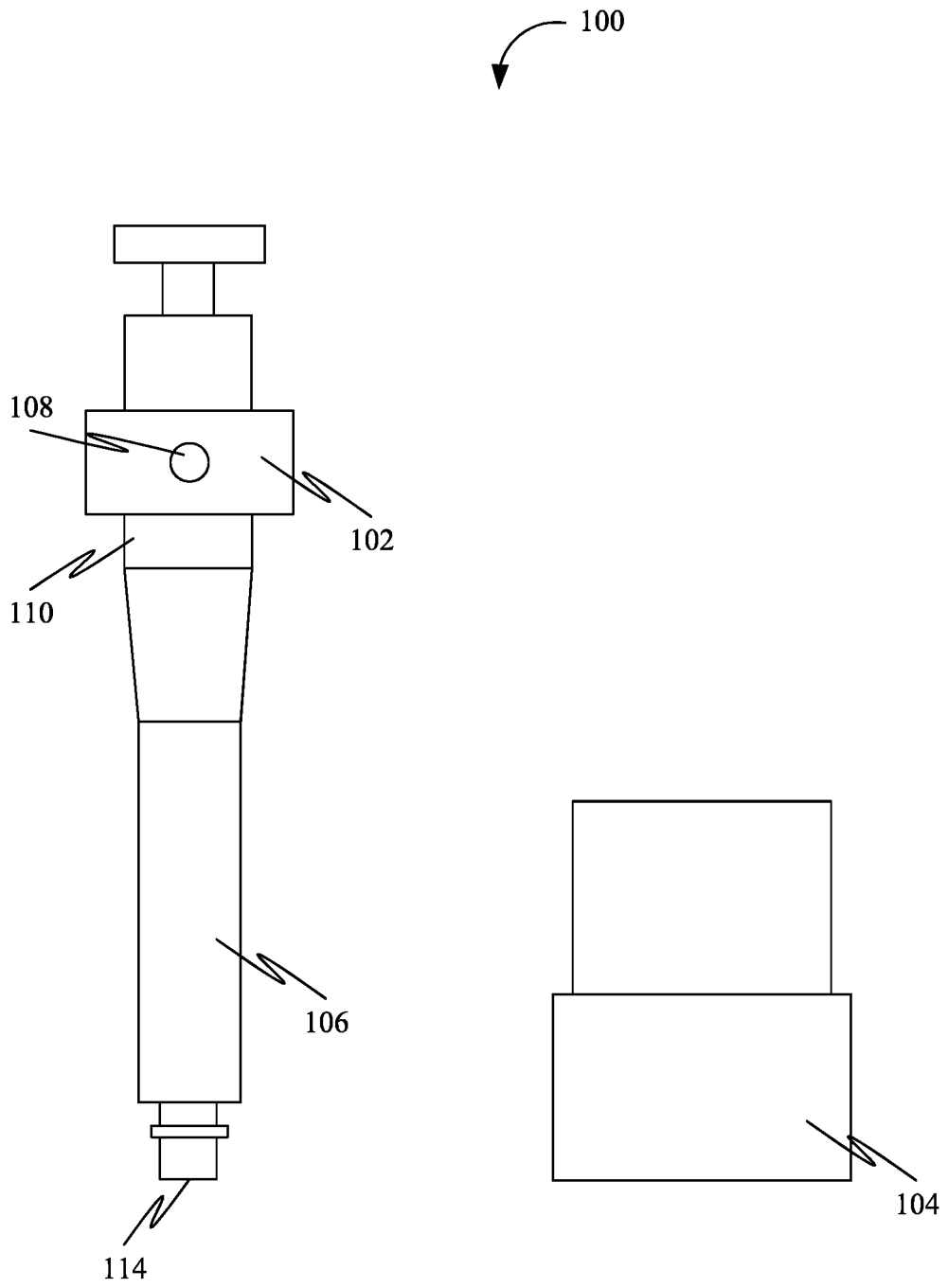
FIG. 4 is a top view of the kit for facilitating aligning of twist-in scope rings of firearms, in accordance with some embodiments.

FIG. 4 is a top view of the kit 100 for facilitating aligning of twist-in scope rings of firearms, in accordance with some embodiments.

Figure 5:
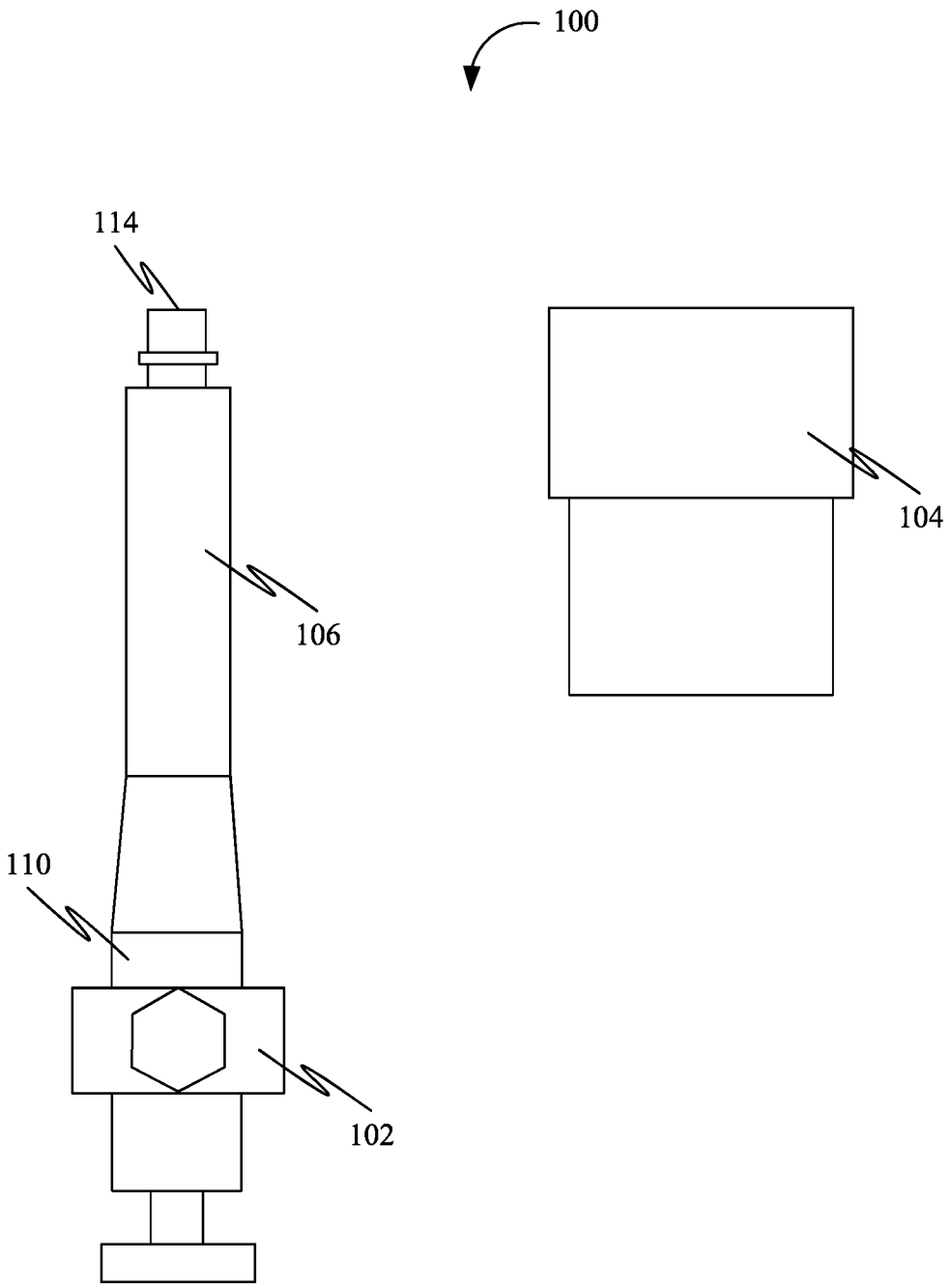
FIG. 5 is a bottom view of the kit for facilitating aligning of twist-in scope rings of firearms, in accordance with some embodiments.

FIG. 5 is a bottom view of the kit 100 for facilitating aligning of twist-in scope rings of firearms, in accordance with some embodiments.

Figure 6:
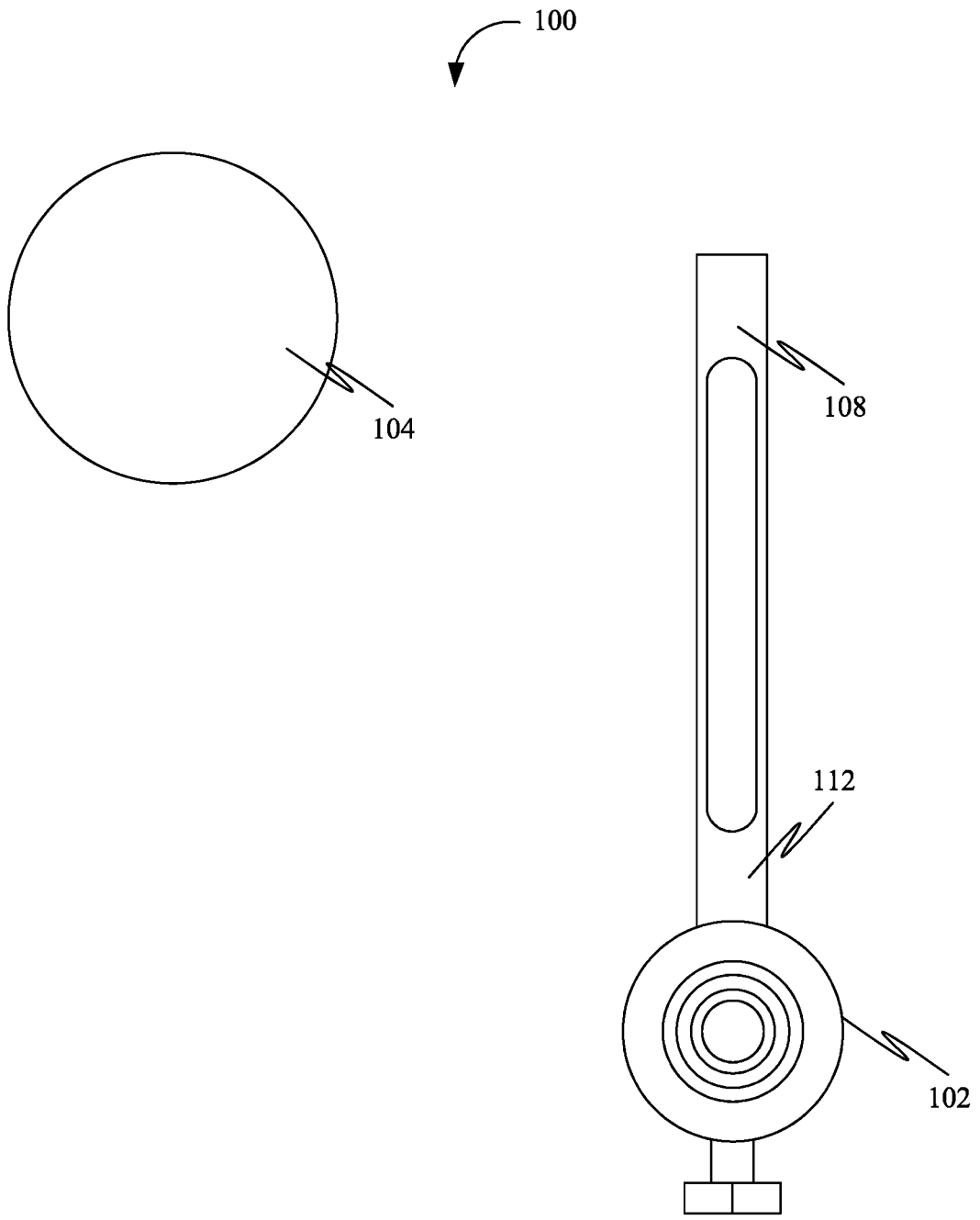
FIG. 6 is a rear view of the kit for facilitating aligning of twist-in scope rings of firearms, in accordance with some embodiments.

FIG. 6 is a rear view of the kit 100 for facilitating aligning of twist-in scope rings of firearms, in accordance with some embodiments.

Figure 7:
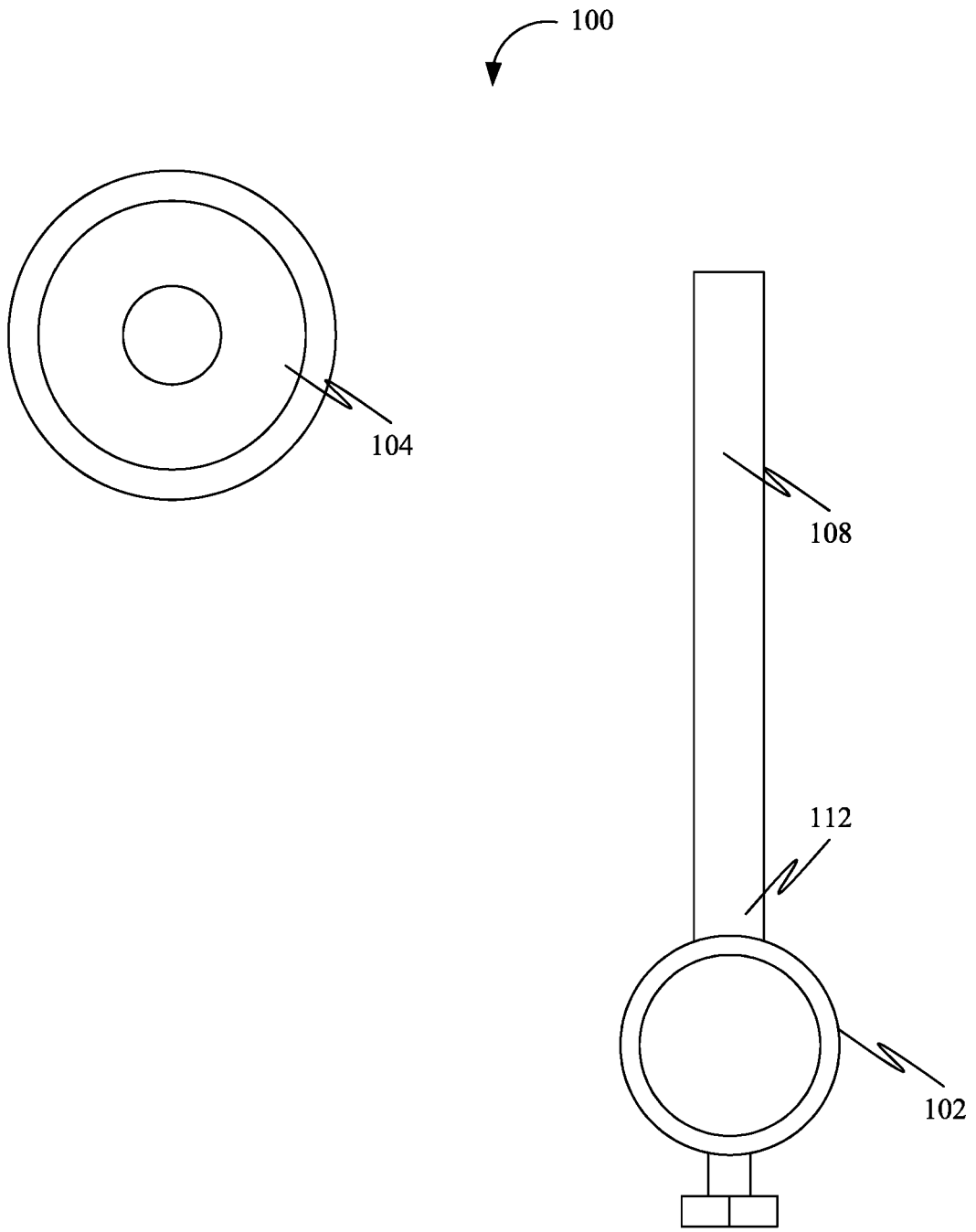
FIG. 7 is a front view of the kit for facilitating aligning of twist-in scope rings of firearms, in accordance with some embodiments.

FIG. 7 is a front view of the kit 100 for facilitating aligning of twist-in scope rings of firearms, in accordance with some embodiments.

FIG. 8 is a perspective view of the kit 100 being used on a firearm, in accordance with some embodiments.

Figure 9:
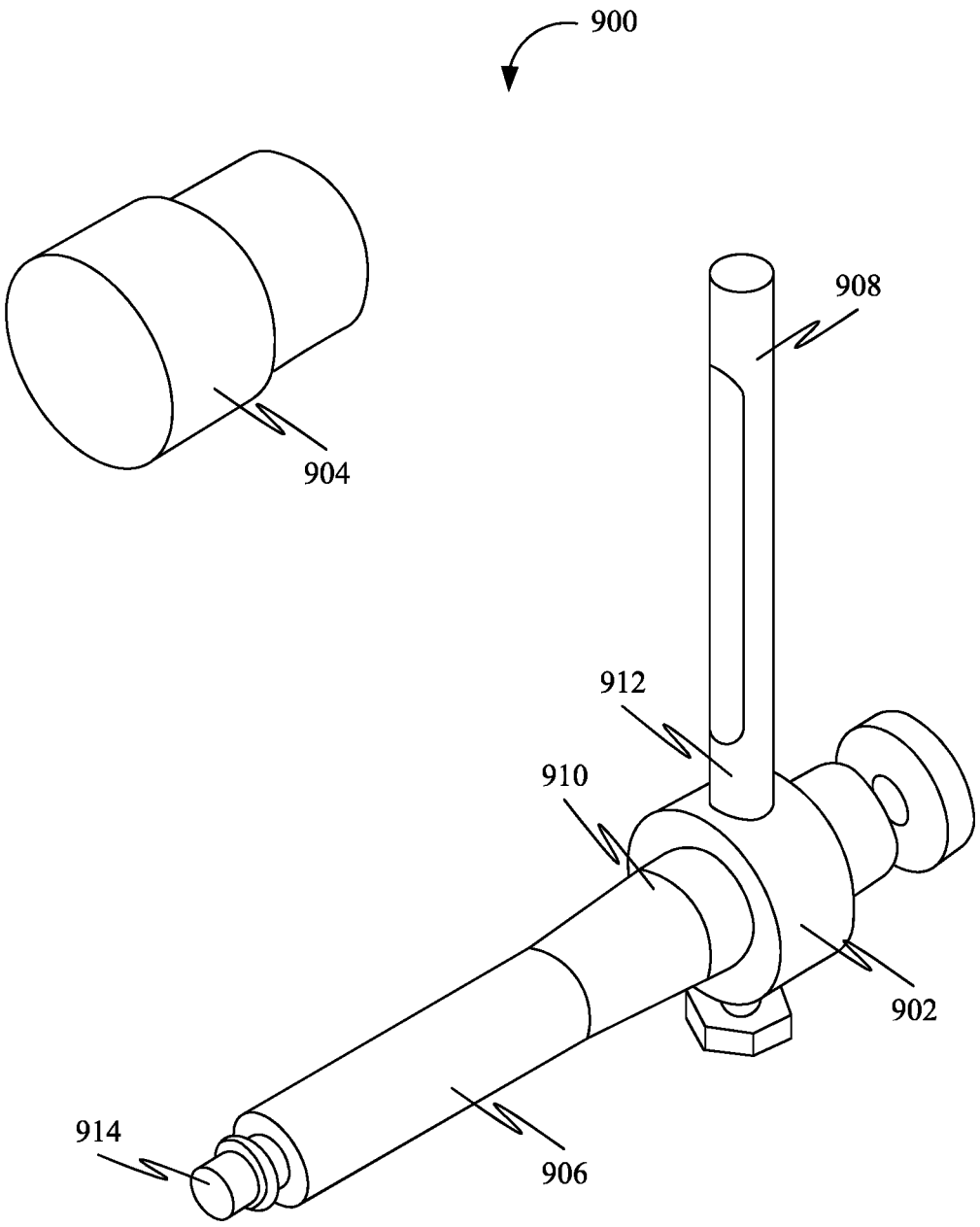
FIG. 9 is a perspective view of a kit for facilitating aligning of twist-in scope rings of firearms, in accordance with some embodiments.

FIG. 9 is a perspective view of a kit 900 for facilitating aligning of twist-in scope rings of firearms, in accordance with some embodiments. Accordingly, the kit 900 may include a centering component 902, and a laser pointer 904.

Figure 16:
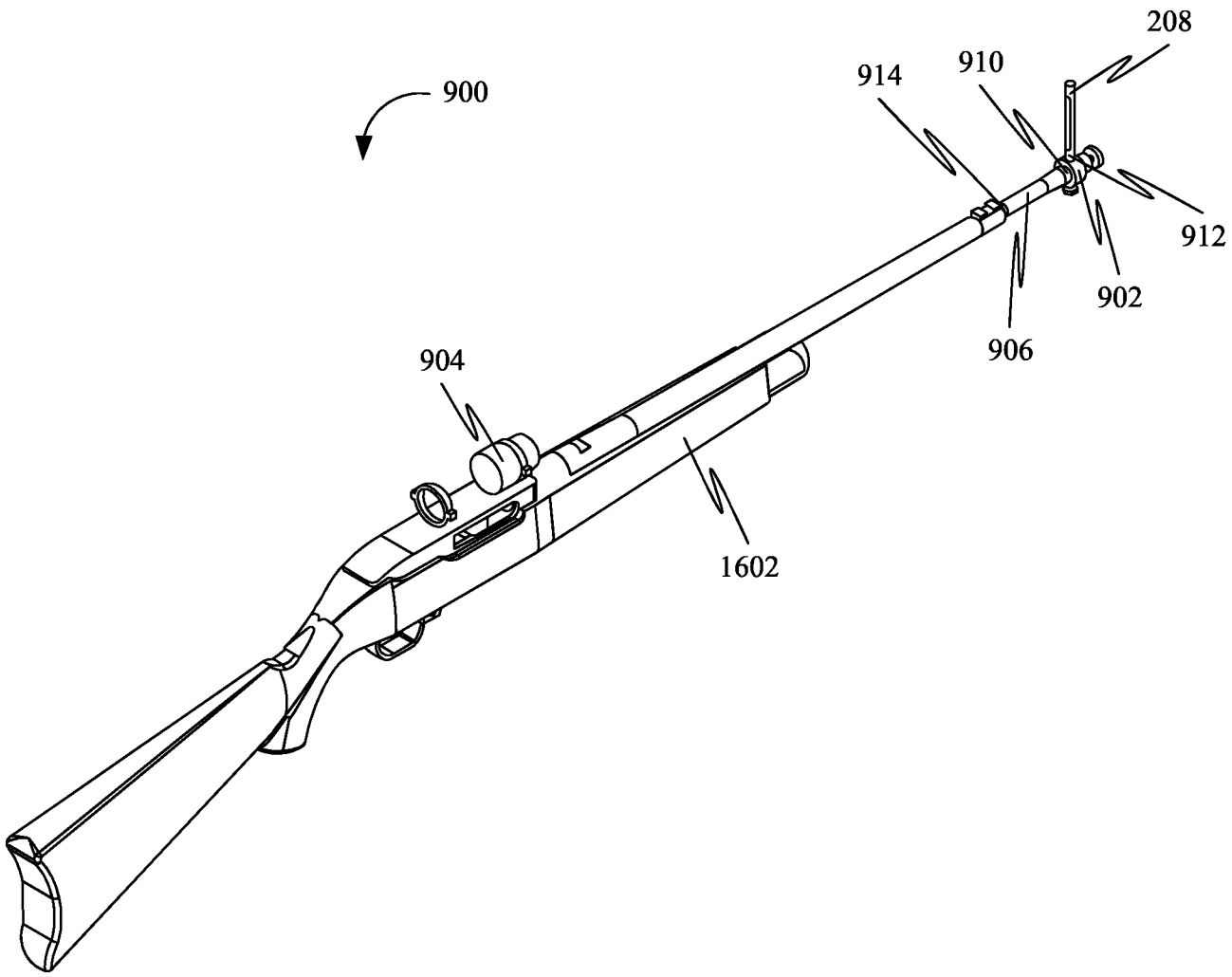
FIG. 16 is a perspective view of the kit being used on a firearm, in accordance with some embodiments.

Further, the centering component 902 may be for providing a reference for aligning a twist-in scope ring (not shown) with a bore of a firearm 1602, as shown in FIG. 16. Further, the twist-in scope ring may be coupled to a barrel of the firearm 1602. Further, the twist-in scope ring may be rotatable around a scope axis. Further, the centering component 902 may include a primary elongated member 906 and a secondary elongated member 908 attached to the primary elongated member 906. Further, a first portion 910 of the primary elongated member 906 may be attached to a second portion 912 of the secondary elongated member 908. Further, a first longitudinal axis of the primary elongated member 906 may be perpendicular to a second longitudinal axis of the secondary elongated member 908. Further, at least one end 914 of the primary elongated member 906 may be configured to be inserted into the bore. Further, the primary elongated member 906 may be configured to rotate in relation to the bore allowing the secondary elongated member 908 to be angularly displaced around a bore axis corresponding to the bore.

Further, the laser pointer 904 may be detachably couplable with the twist-in scope ring (not shown). Further, the laser pointer 904 may be configured for emitting a laser beam. Further, the laser pointer 904 may include a laser pointer body configured to be inserted in the twist-in scope ring. Further, the laser pointer body characterized by a pointer circumference and a pointer length. Further, the pointer circumference may be equal to an inner scope ring circumference restricting lateral movement of the laser pointer 904 in relation to a scope ring axis of the twist-in scope ring.

Further, in some embodiments, the primary elongated member 906 may be characterized by a primary length and a primary circumference. Further, the primary circumference remains constant along the primary length. Further, an inner bore circumference of the bore may be equal to the primary circumference restricting lateral movement of the primary elongated member 906 in relation to the bore axis.

Further, in some embodiments, the primary elongated member 906 may be characterized by a primary member length and a primary member circumference. Further, the primary circumference progressively increases along the primary member length. Further, a primary circumference corresponding to a primary member length may be equal to an inner bore circumference of the bore restricting lateral movement of the primary elongated member 906 in relation to the bore axis.

Further, in some embodiments, the pointer circumference remains constant along the pointer length. Further, the pointer circumference may be equal to an inner scope ring circumference restricting lateral movement of the laser pointer 904 in relation to a scope ring axis of the twist-in scope ring.

Further, in some embodiments, the pointer circumference progressively decreases along the pointer length. Further, a pointer circumference corresponding to a pointer length may be equal to an inner scope ring circumference restricting lateral movement of the laser pointer 904 in relation to a scope ring axis of the twist-in scope ring.

Further, in some embodiments, the secondary elongated member 908 may be characterized by a secondary diameter and a secondary length. Further, the secondary diameter may be greater than a width of the laser beam.

Further, in some embodiments, the secondary elongated member 908 may include an imprinted surface. Further, the imprinted surface may be configured for reflecting the laser beam for viewing.

Further, in some embodiments, the laser pointer body may include a plurality of cylindrical members (not shown) corresponding to a plurality of twist-in scope rings (not shown) of the firearm 1602. Further, each cylindrical member may be characterized by a pointer member circumference. Further, a first cylindrical member attached to a second cylindrical member concentrically. Further, a first pointer member circumference of the first cylindrical member may be equal to a first inner scope ring circumference of a first twist-in scope ring and a second pointer member circumference of the second cylindrical member may be equal to a second inner scope ring circumference of a second twist-in scope ring.

Further, in some embodiments, the centering component 902 may include an inclinometer (not shown). Further, the inclinometer may be disposed on a first end of the primary elongated member 906. Further, the inclinometer may be configured for determining a degree of rotation for the primary elongated member 906 in relation to the bore.

Figure 10:
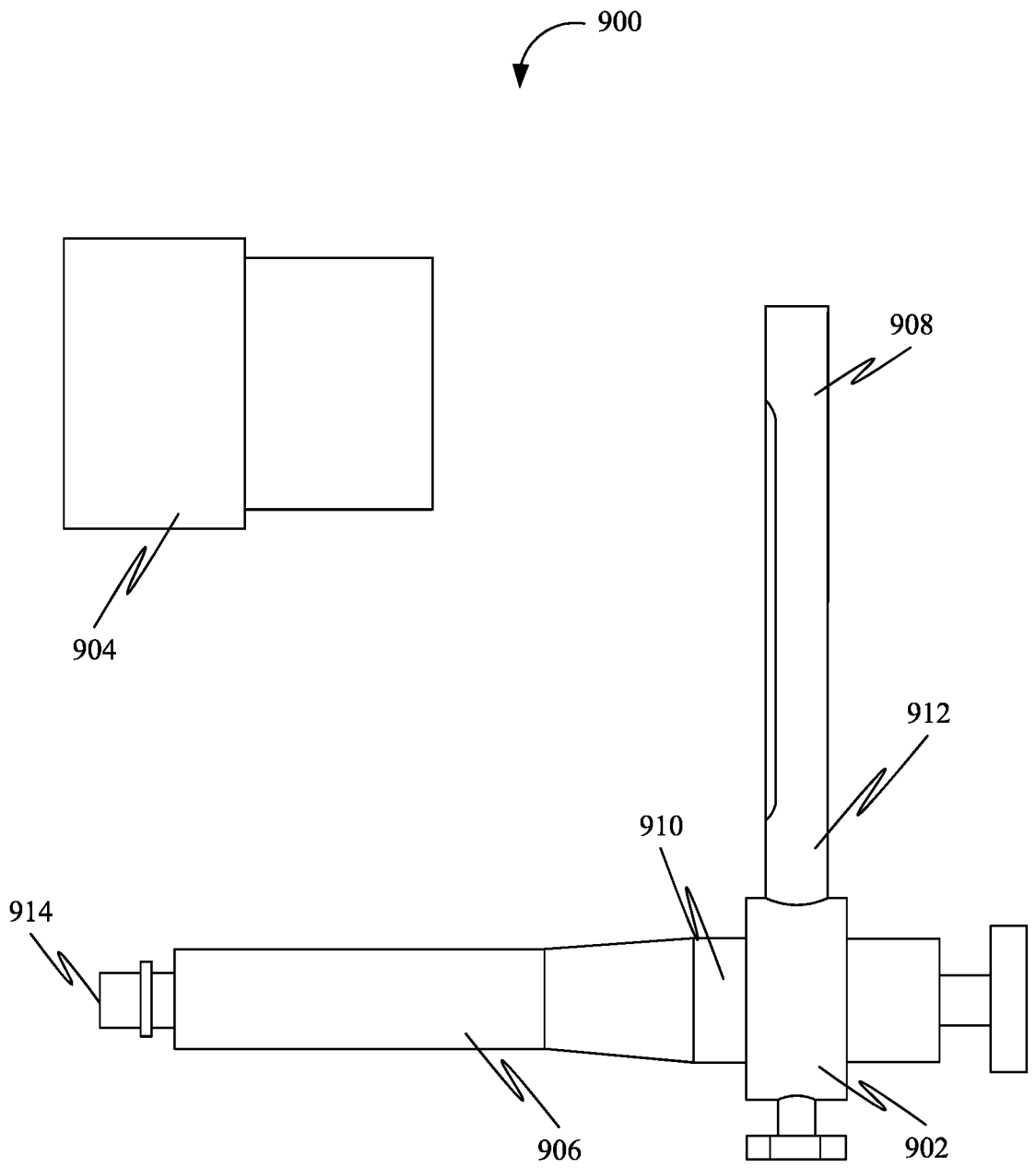
FIG. 10 is a left-side view of the kit for facilitating aligning of twist-in scope rings of firearms, in accordance with some embodiments.

FIG. 10 is a left-side view of the kit 900 for facilitating aligning of twist-in scope rings of firearms, in accordance with some embodiments.

Figure 11:
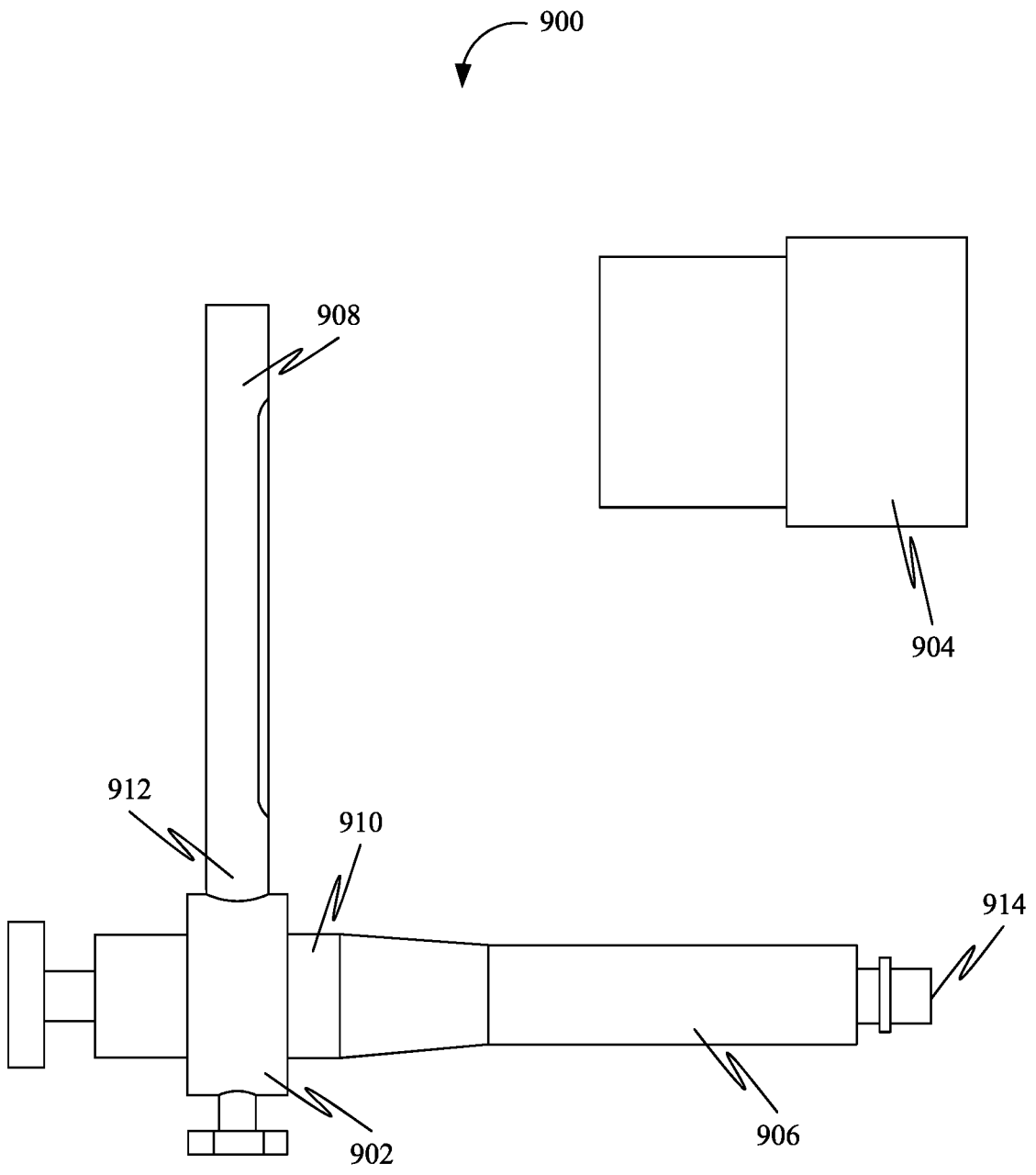
FIG. 11 is a right-side view of the kit for facilitating aligning of twist-in scope rings of firearms, in accordance with some embodiments.

FIG. 11 is a right-side view of the kit 900 for facilitating aligning of twist-in scope rings of firearms, in accordance with some embodiments.

Figure 12:
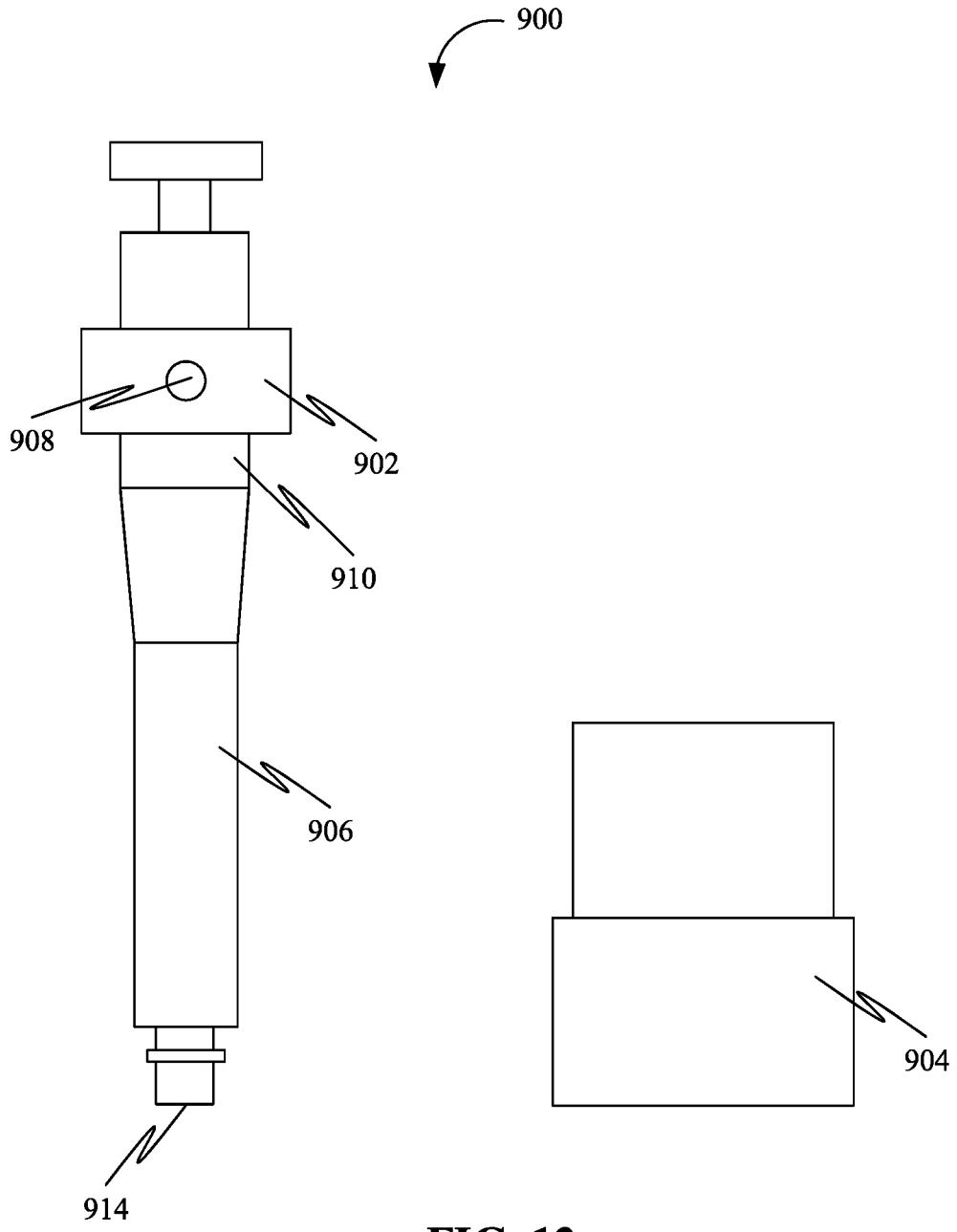
FIG. 12 is a top view of the kit for facilitating aligning of twist-in scope rings of firearms, in accordance with some embodiments.

FIG. 12 is a top view of the kit 900 for facilitating aligning of twist-in scope rings of firearms, in accordance with some embodiments.

Figure 13:
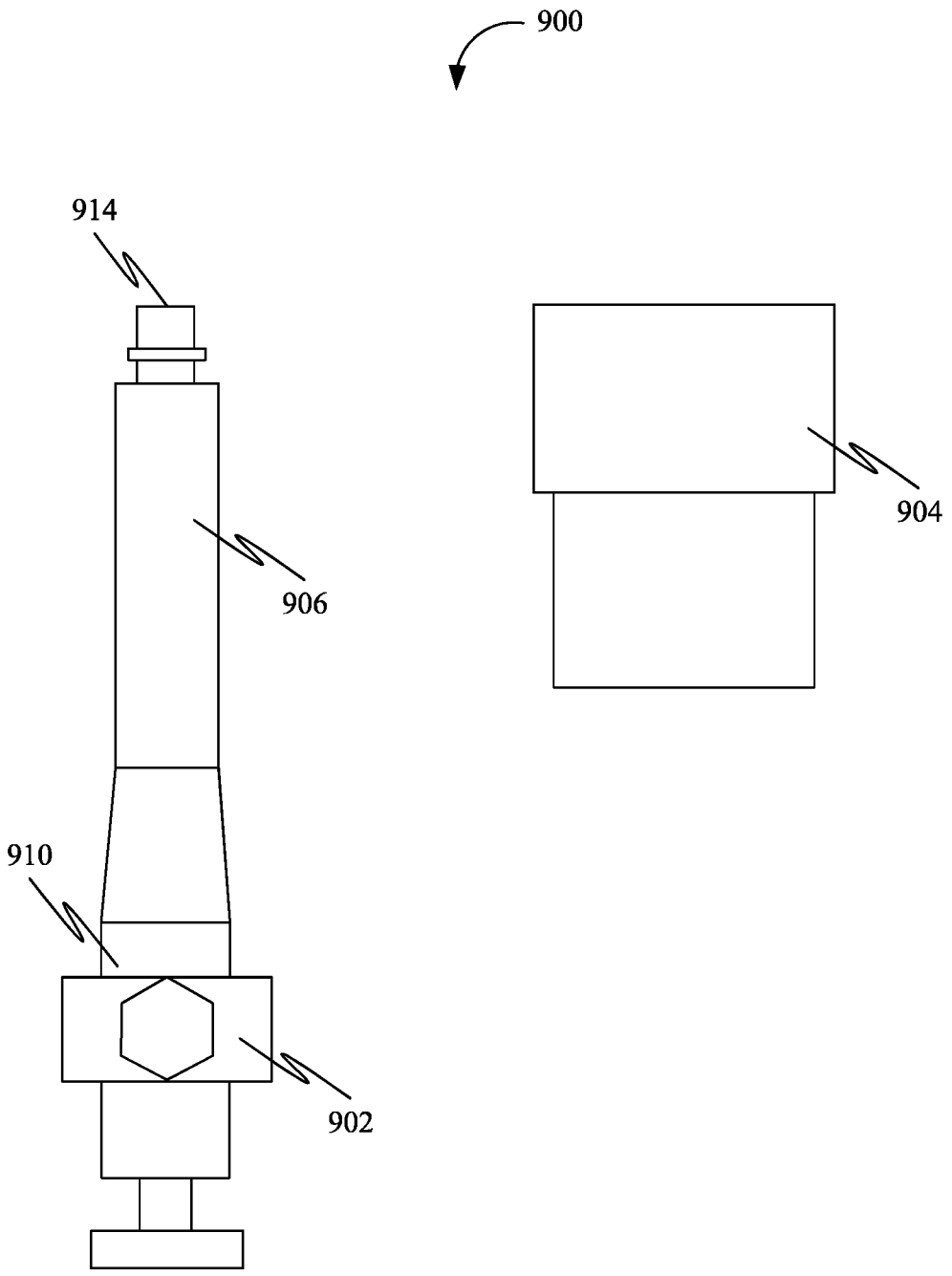
FIG. 13 is a bottom view of the kit for facilitating aligning of twist-in scope rings of firearms, in accordance with some embodiments.

FIG. 13 is a bottom view of the kit 900 for facilitating aligning of twist-in scope rings of firearms, in accordance with some embodiments.

Figure 14:
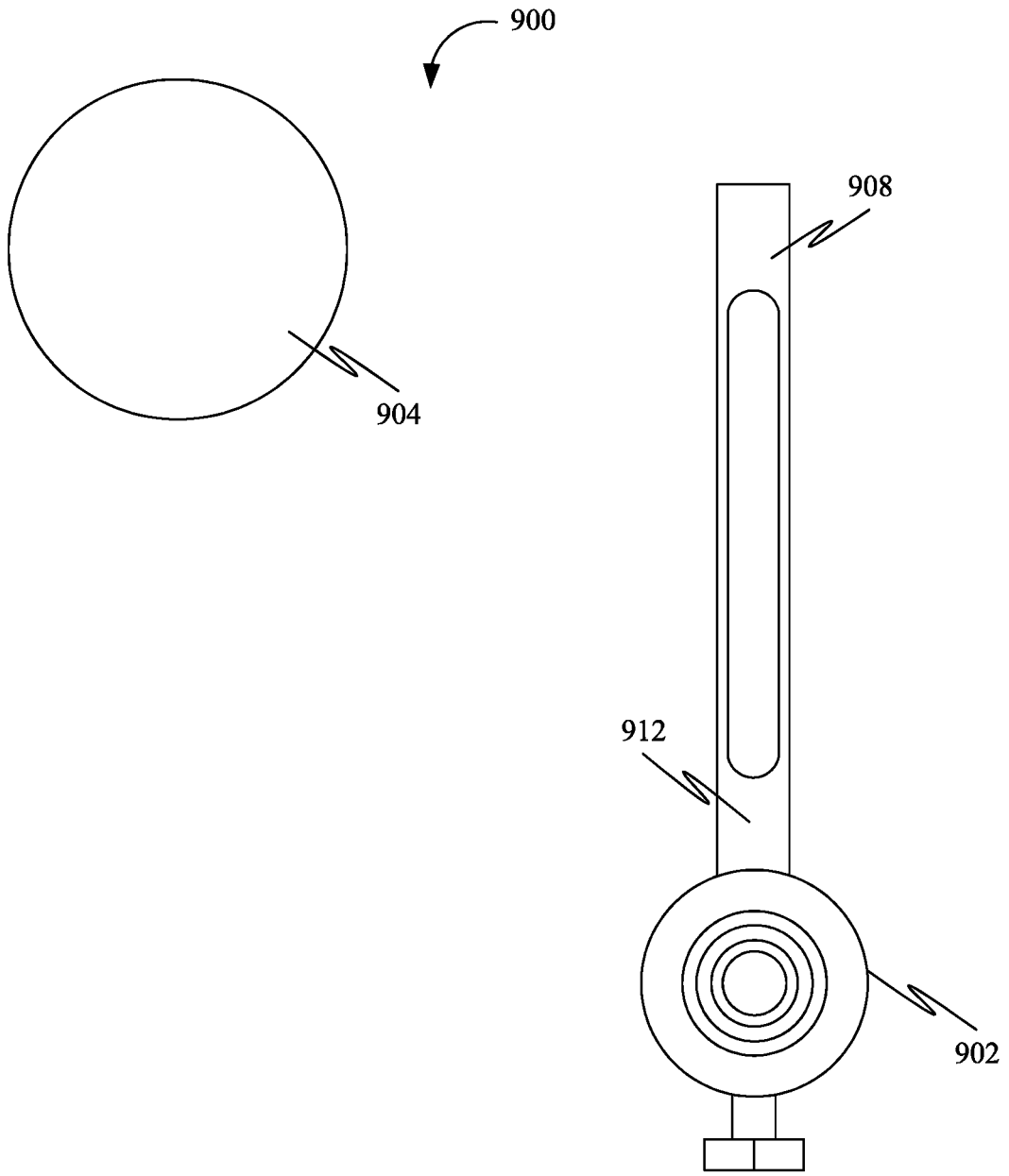
FIG. 14 is a rear view of the kit for facilitating aligning of twist-in scope rings of firearms, in accordance with some embodiments.

FIG. 14 is a rear view of the kit 900 for facilitating aligning of twist-in scope rings of firearms, in accordance with some embodiments.

Figure 15:
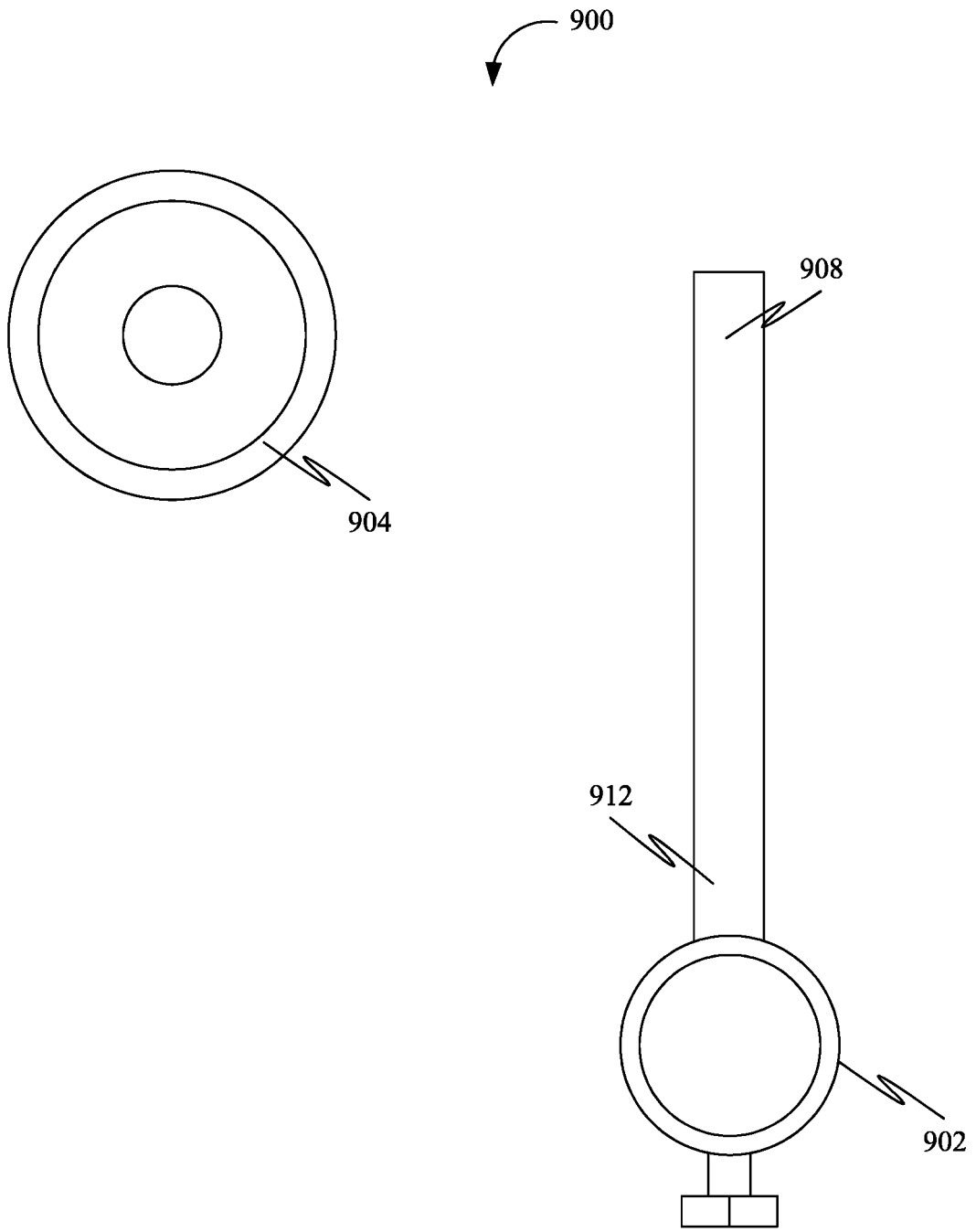
FIG. 15 is a front view of the kit for facilitating aligning of twist-in scope rings of firearms, in accordance with some embodiments.

FIG. 15 is a front view of the kit 900 for facilitating aligning of twist-in scope rings of firearms, in accordance with some embodiments.

FIG. 16 is a perspective view of the kit 900 being used on a firearm 1602, in accordance with some embodiments.

Figure 17:
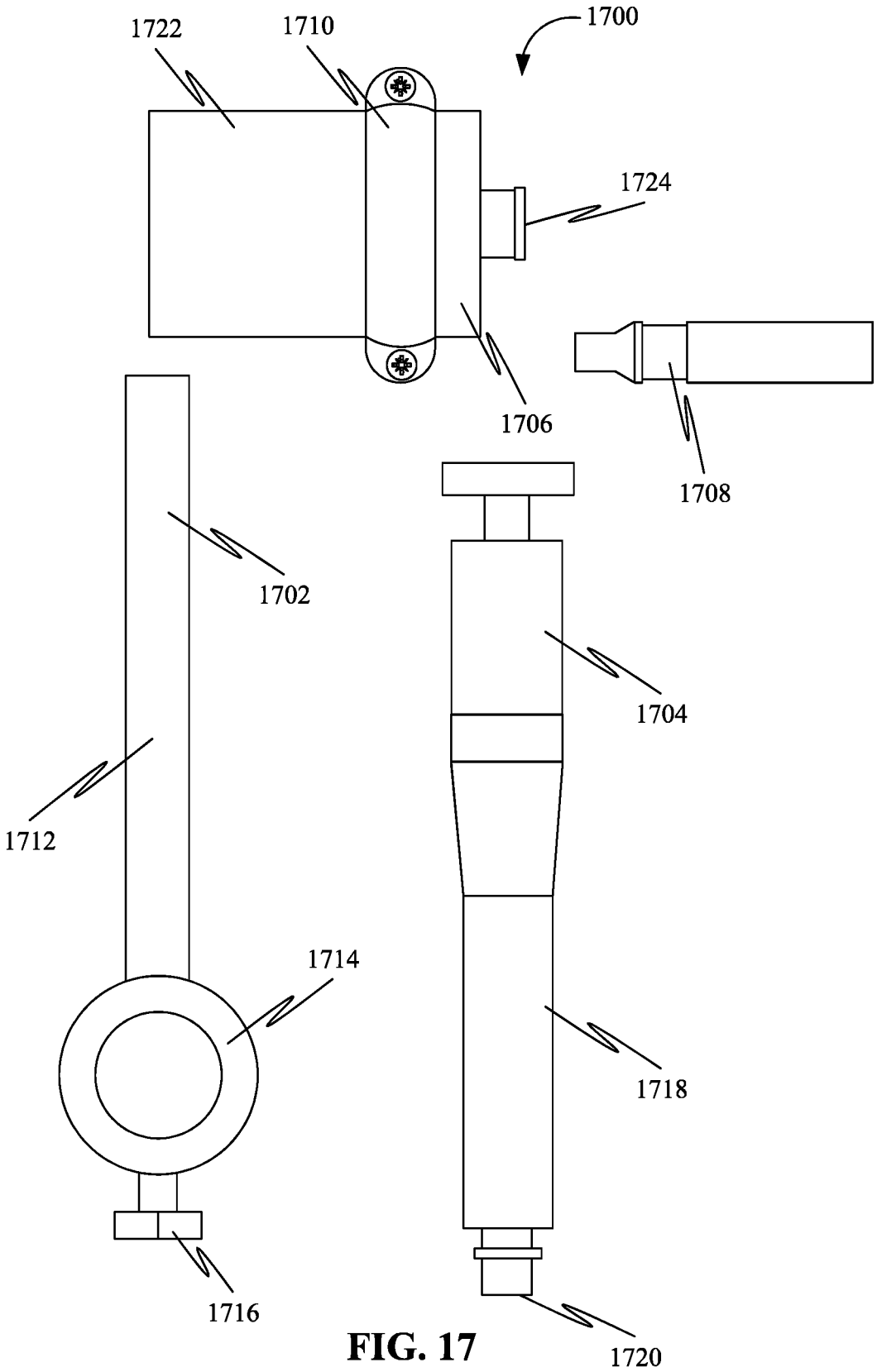
FIG. 17 is a side view of a kit for facilitating aligning of twist-in scope rings of firearms, in accordance with some embodiments.

FIG. 17 is a side view of a kit 1700 for facilitating aligning of twist-in scope rings of firearms, in accordance with some embodiments. Accordingly, the kit 1700 may include a centering component 1702, an arbor 1704, a laser barrel 1706, and a laser pointer 1708.

Further, the centering component 1702 may be for providing a reference for aligning a twist-in scope ring 1710 with a bore of a firearm (not shown). Further, the twist-in scope ring 1710 may be coupled to a barrel of the firearm. Further, the twist-in scope ring 1710 may be rotatable around a scope axis. Further, the centering component 1702 may include a centering rod 1712, a ring 1714, and a fastener 1716. Further, the centering rod 1712 may include a rod elongated member (not shown). Further, the rod elongated member may include an imprinted surface. Further, the ring 1714 may include an annular member extending between an outer periphery and an inner periphery forming a ring cavity (not shown). Further, a first rod end of the rod elongated member may be attached to the annular body on the outer periphery. Further, the ring 1714 may include a threaded cavity disposed on the annular member. Further, the fastener 1716 may include a threaded member (not shown) and a knob disposed on a first fastener end of the threaded member. Further, the threaded member may be threadedly coupled with the threaded cavity.

Further, the arbor 1704 may be detachably coupled with the centering component 1702. Further, the arbor 1704 may include an arbor elongated member 1718. Further, the ring cavity may be configured for receiving the arbor elongated member 1718. Further, an arbor longitudinal axis of the arbor elongated member 1718 may be perpendicular to a rod longitudinal axis of the rod elongated member. Further, at least on end 1720 of the arbor elongated member 1718 may be configured to be inserted in the bore. Further, the ring 1714 may be configured to rotate in relation to the bore allowing the centering rod 1712 to be angularly displaced around a bore axis corresponding to the bore.

Further, the laser barrel 1706 may include a cylindrical member 1722. Further, the twist-in scope ring 1710 of a ring circumference may be configured for encompassing the cylindrical member 1722 circumferentially. Further, the laser barrel 1706 may include a barrel cavity 1724 disposed in the cylindrical member 1722. Further, the barrel cavity 1724 may be concentric with the cylindrical member 1722. Further, the barrel cavity 1724 may include a cavity opening disposed on a circular surface of the cylindrical member 1722.

Further, the laser pointer 1708 may be disposed in the barrel cavity 1724. Further, the laser pointer 1708 may be configured for emitting a laser beam.

Further, in some embodiments, the laser barrel 1706 may include a plurality of cylindrical members corresponding to a plurality of twist-in scope rings. Further, each cylindrical member may be characterized by a cylindrical member circumference. Further, a first cylindrical member of a first circumference may be attached to a second cylindrical member of a second circumference concentrically. Further, a first twist-in scope ring may be configured to receive the first cylindrical member and a second twist-in scope ring may be configured to receive the second cylindrical member.

Figure 18:
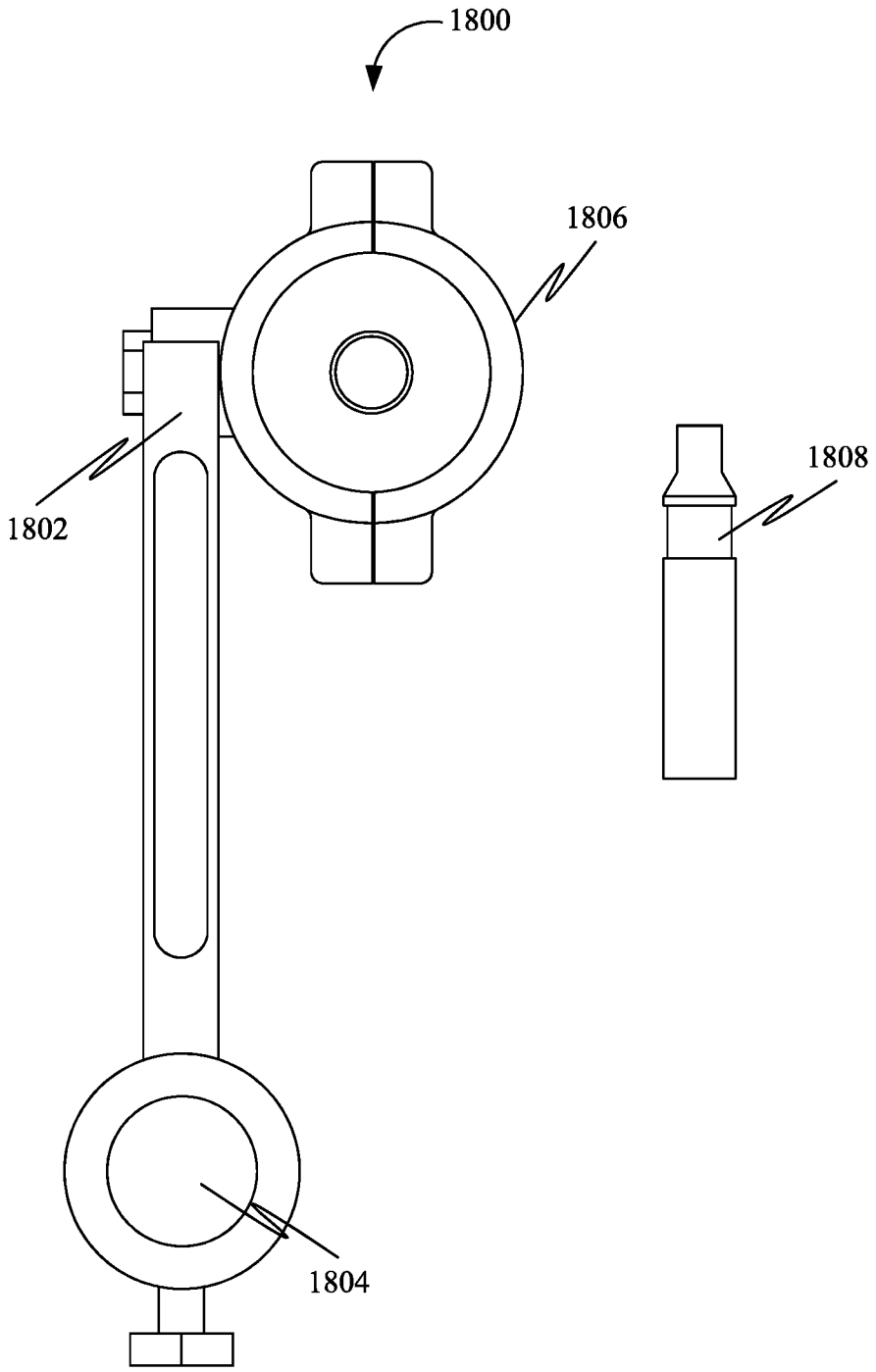
FIG. 18 is a side view of a kit upon being assembled, in accordance with some embodiments.

FIG. 18 is a side view of a kit 1800 upon being assembled, in accordance with some embodiments. Accordingly, the kit 1800 may include a centering component 1802, an arbor 1804, a laser barrel 1806, and a laser pointer 1808. Further, the centering component 1802 may be for providing a reference for aligning a twist-in scope ring with a bore of a firearm. Further, the arbor 1804 may be detachably coupled with the centering component 1802. Further, the laser barrel 1806 may include a cylindrical member. Further, the twist-in scope ring of a ring circumference may be configured for encompassing the cylindrical member circumferentially. Further, the laser pointer 1808 may be disposed in the barrel cavity. Further, the laser pointer 1808 may be configured for emitting a laser beam.

Figure 19:
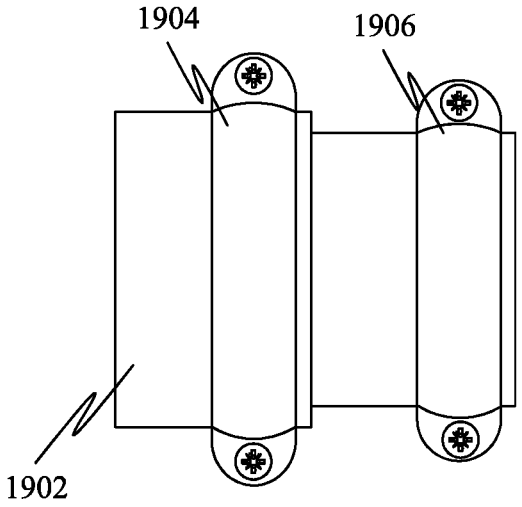
FIG. 19 is a side view of a laser barrel with a plurality of twist-in scope rings, in accordance with some embodiments.

FIG. 19 is a side view of a laser barrel 1902 with a plurality of twist-in scope rings 1904-1906, in accordance with some embodiments. Further, the laser barrel 1902 may include a plurality of cylindrical members corresponding to the plurality of twist-in scope rings 1904-1906. Further, each cylindrical member may be characterized by a cylindrical member circumference. Further, a first cylindrical member of a first circumference may be attached to a second cylindrical member of a second circumference concentrically. Further, a first twist-in scope ring 1904 may be configured to receive the first cylindrical member and a second twist-in scope ring 1906 may be configured to receive the second cylindrical member.

Figure 20:
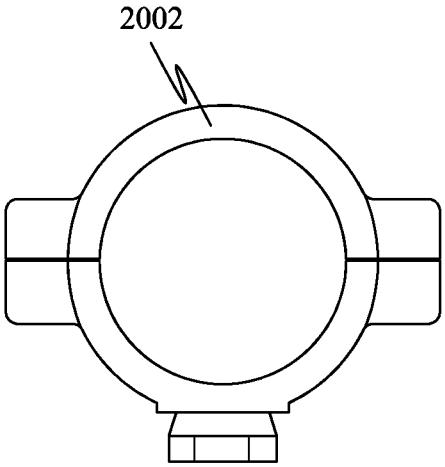
FIG. 20 is a front view of a twist-in scope ring, in accordance with some embodiments.

FIG. 20 is a front view of a twist-in scope ring 2002, in accordance with some embodiments.

Figure 21:
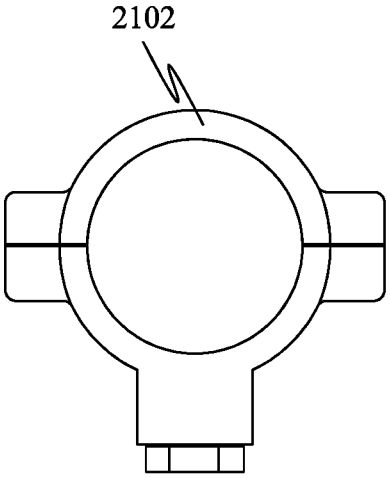
FIG. 21 is a front view of a twist-in scope ring, in accordance with some embodiments.

FIG. 21 is a front view of a twist-in scope ring 2102, in accordance with some embodiments.

Figure 22:
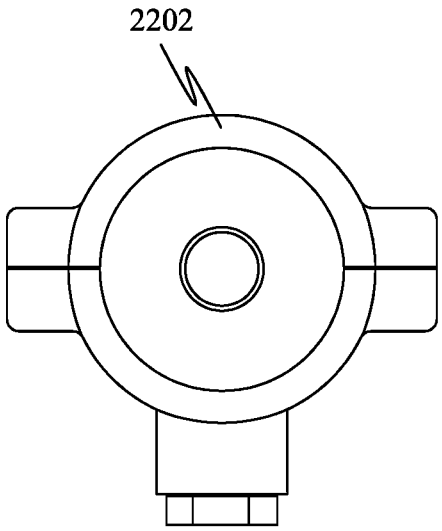
FIG. 22 is a front view of a laser barrel, in accordance with some embodiments.

FIG. 22 is a front view of a laser barrel 2202, in accordance with some embodiments. Further, the laser barrel 2202 may include a cylindrical member. Further, the twist-in scope ring of a ring circumference may be configured for encompassing the cylindrical member circumferentially. Further, the laser barrel 2202 may include a barrel cavity disposed in the cylindrical member. Further, the barrel cavity may be concentric with the cylindrical member. Further, the barrel cavity may include a cavity opening disposed on a circular surface of the cylindrical member.

Figure 23:
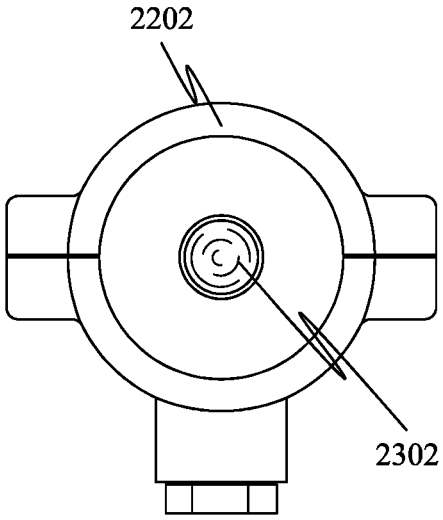
FIG. 23 is a front view of the laser barrel with a laser pointer, in accordance with some embodiments.

FIG. 23 is a front view of the laser barrel 2202 with a laser pointer 2302, in accordance with some embodiments. Further, the laser pointer 2302 may be disposed in the barrel cavity. Further, the laser pointer 2302 may be configured for emitting a laser beam.

Figure 24:
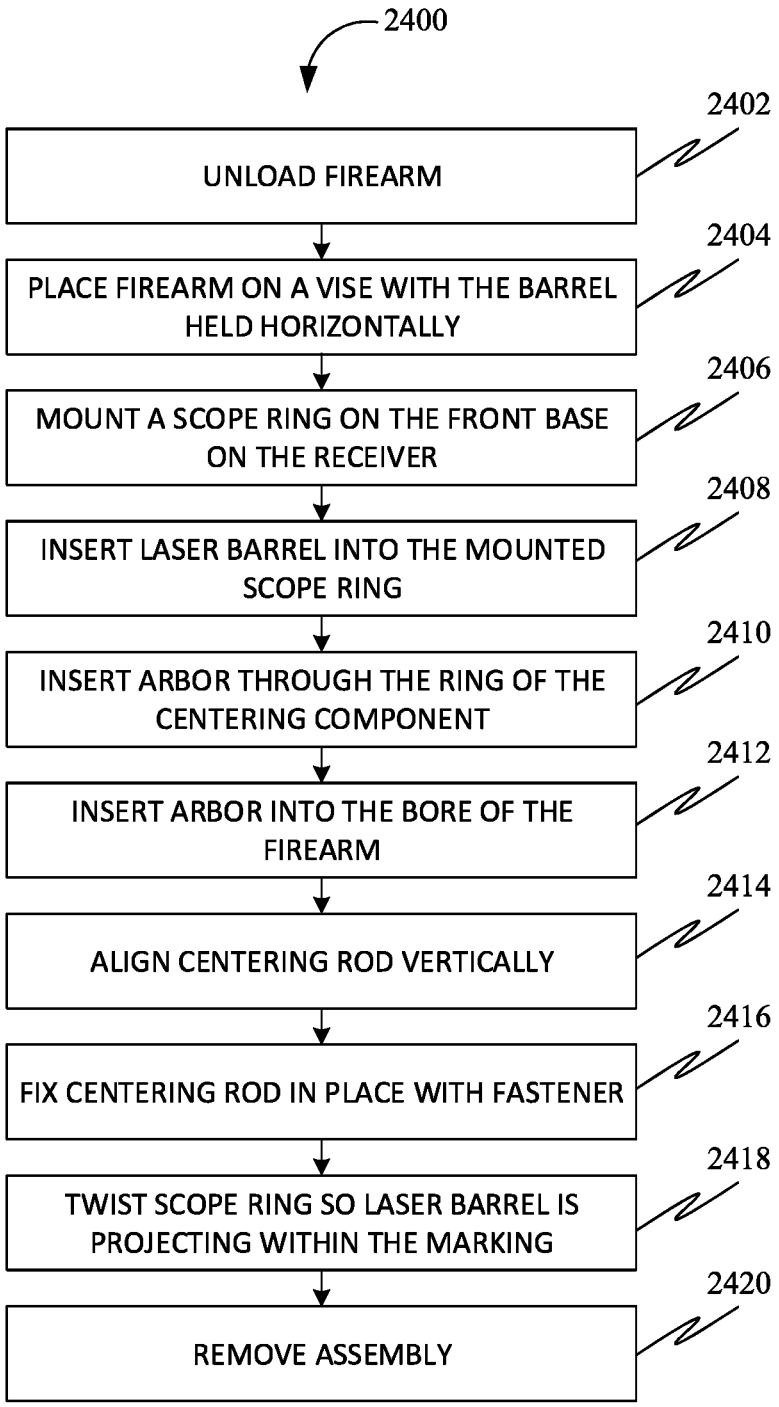
FIG. 24 is a flowchart of a method for facilitating aligning of twist-in scope rings of firearms, in accordance with some embodiments.

FIG. 24 is a flowchart of a method 2400 for facilitating aligning of twist-in scope rings of firearms, in accordance with some embodiments. Further, the objective of the method 2400 may be to mount and accurately align the front twist-in scope ring to the barrel. Further, at 2402, the method 2400 may include a step of unloading a firearm. Further, at 2404, the method 2400 may include a step of positioning the firearm such that the barrel is being held up horizontally by a vise and lever, and further levelling the front twist-in scope ring. Further, at 2406, the method 2400 may include a step of mounting a ring onto the front base on the receiver of a firearm. Further, at 2408, the method 2400 may include a step of inserting the laser barrel into the ring. Further, at 2410, the method 2400 may include a step of inserting the arbor into the ring of the centering component and tightening with a thumb screw. Further, at 2412, the method 2400 may include a step of inserting the arbor into the bore of the firearm with the ring of the centering component concentric to the arbor. Further, at 2414, the method 2400 may include a step of aligning the centering rod vertically in respect to the axis of the arbor. Further, at 2416, the method 2400 may include a step of ensuring the centering rod stays vertical by the fastener. Further, at 2418, the method 2400 may include a step of twisting the twist-in scope ring such that the laser barrel is projecting a beam that is completely in the marking on the centering rod. Further, at 2420, the method 2400 may include a step of removing the assembly and the scope will be properly aligned to the bore of the firearm when the scope is attached to the firearm.

Although the present disclosure has been explained in relation to its preferred embodiment, it is to be understood that many other possible modifications and variations can be made without departing from the spirit and scope of the disclosure.

What is claimed is:

1. A kit for facilitating aligning of twist-in scope rings of firearms, the kit comprising:

a centering component for providing a reference for aligning a twist-in scope ring with a bore of a firearm, wherein the twist-in scope ring is coupled to a barrel of the firearm, wherein the twist-in scope ring is rotatable around a scope axis, wherein the centering component comprises a primary elongated member and a secondary elongated member attached to the primary elongated member, wherein a first portion of the primary elongated member is attached to a second portion of the secondary elongated member, wherein a first longitudinal axis of the primary elongated member is perpendicular to a second longitudinal axis of the secondary elongated member, wherein at least one end of the primary elongated member is configured to be inserted into the bore, wherein the primary elongated member is configured to rotate in relation to the bore allowing the secondary elongated member to be angularly displaced around a bore axis corresponding to the bore; and a laser pointer detachably couplable with the twist-in scope ring, wherein the laser pointer comprises a laser pointer body configured to be inserted in the twist-in scope ring, wherein the laser pointer is configured for emitting a laser beam.

2. The kit of claim 1, wherein the primary elongated member is characterized by a primary length and a primary circumference, wherein the primary circumference remains constant along the primary length, wherein an inner bore circumference of the bore is equal to the primary circumference restricting lateral movement of the primary elongated member in relation to the bore axis.

3. The kit of claim 1, wherein the primary elongated member is characterized by a primary member length and a primary member circumference, wherein the primary circumference progressively increases along the primary member length, wherein a primary circumference corresponding to a primary member length is equal to an inner bore circumference of the bore restricting lateral movement of the primary elongated member in relation to the bore axis.

4. The kit of claim 1, wherein the laser pointer comprises a laser pointer body characterized by a pointer circumference and a pointer length, wherein the pointer circumference remains constant along the pointer length, wherein the pointer circumference is equal to an inner scope ring circumference restricting lateral movement of the laser pointer in relation to a scope ring axis of the twist-in scope ring.

5. The kit of claim 1, wherein the laser pointer comprises a laser pointer body characterized by a pointer circumference and a pointer length, wherein the pointer circumference progressively decreases along the pointer length, wherein a pointer circumference corresponding to a pointer length is equal to an inner scope ring circumference restricting lateral movement of the laser pointer in relation to a scope ring axis of the twist-in scope ring.

6. The kit of claim 1, wherein the secondary elongated member is characterized by a secondary diameter, wherein the secondary diameter is greater than a width of the laser beam.

7. The kit of claim 1, wherein the secondary elongated member comprises an imprinted surface, wherein the imprinted surface is configured for reflecting the laser beam for viewing.

8. The kit of claim 1, wherein the laser pointer body comprises a plurality of cylindrical members corresponding to a plurality of twist-in scope rings of the firearm, wherein each cylindrical member is characterized by a pointer member circumference, wherein a first cylindrical member attached to a second cylindrical member concentrically, wherein a first pointer member circumference of the first cylindrical member is equal to a first inner scope ring circumference of a first twist-in scope ring and a second pointer member circumference of the second cylindrical member is equal to a second inner scope ring circumference of a second twist-in scope ring.

9. The kit of claim 1, wherein the centering component comprises an inclinometer, wherein the inclinometer is disposed on a first end of the primary elongated member, wherein the inclinometer is configured for determining a degree of rotation for the primary elongated member in relation to the bore.

10. A kit for facilitating aligning of twist-in scope rings of firearms, the kit comprising:

a centering component for providing a reference for aligning a twist-in scope ring with a bore of a firearm, wherein the twist-in scope ring is coupled to a barrel of the firearm, wherein the twist-in scope ring is rotatable around a scope axis, wherein the centering component comprises a primary elongated member and a secondary elongated member attached to the primary elongated member, wherein a first portion of the primary elongated member is attached to a second portion of the secondary elongated member, wherein a first longitudinal axis of the primary elongated member is perpendicular to a second longitudinal axis of the secondary elongated member, wherein at least one end of the primary elongated member is configured to be inserted into the bore, wherein the primary elongated member is configured to rotate in relation to the bore allowing the secondary elongated member to be angularly displaced around a bore axis corresponding to the bore; and a laser pointer detachably couplable with the twist-in scope ring, wherein the laser pointer is configured for emitting a laser beam, wherein the laser pointer comprises a laser pointer body configured to be inserted in the twist-in scope ring, wherein the laser pointer body characterized by a pointer circumference and a pointer length, wherein the pointer circumference is equal to an inner scope ring circumference restricting lateral movement of the laser pointer in relation to a scope ring axis of the twist-in scope ring.

11. The kit of claim 10, wherein the primary elongated member is characterized by a primary length and a primary circumference, wherein the primary circumference remains constant along the primary length, wherein an inner bore circumference of the bore is equal to the primary circumference restricting lateral movement of the primary elongated member in relation to the bore axis.

12. The kit of claim 10, wherein the primary elongated member is characterized by a primary member length and a primary member circumference, wherein the primary circumference progressively increases along the primary member length, wherein a primary circumference corresponding to a primary member length is equal to an inner bore circumference of the bore restricting lateral movement of the primary elongated member in relation to the bore axis.

13. The kit of claim 10, wherein the pointer circumference remains constant along the pointer length, wherein the pointer circumference is equal to an inner scope ring circumference restricting lateral movement of the laser pointer in relation to a scope ring axis of the twist-in scope ring.

14. The kit of claim 10, wherein the pointer circumference progressively decreases along the pointer length, wherein a pointer circumference corresponding to a pointer length is equal to an inner scope ring circumference restricting lateral movement of the laser pointer in relation to a scope ring axis of the twist-in scope ring.

15. The kit of claim 10, wherein the secondary elongated member is characterized by a secondary diameter and a secondary length, wherein the secondary diameter is greater than a width of the laser beam.

16. The kit of claim 10, wherein the secondary elongated member comprises an imprinted surface, wherein the imprinted surface is configured for reflecting the laser beam for viewing.

17. The kit of claim 10, wherein the laser pointer body comprises a plurality of cylindrical members corresponding to a plurality of twist-in scope rings of the firearm, wherein each cylindrical member is characterized by a pointer member circumference, wherein a first cylindrical member attached to a second cylindrical member concentrically, wherein a first pointer member circumference of the first cylindrical member is equal to a first inner scope ring circumference of a first twist-in scope ring and a second pointer member circumference of the second cylindrical member is equal to a second inner scope ring circumference of a second twist-in scope ring.

18. The kit of claim 10, wherein the centering component comprises an inclinometer, wherein the inclinometer is disposed on a first end of the primary elongated member, wherein the inclinometer is configured for determining a degree of rotation for the primary elongated member in relation to the bore.

19. A kit for facilitating aligning of twist-in scope rings of firearms, the kit comprising:

a centering component for providing a reference for aligning a twist-in scope ring with a bore of a firearm, wherein the twist-in scope ring is coupled to a barrel of the firearm, wherein the twist-in scope ring is rotatable around a scope axis, wherein the centering component comprises:

a centering rod comprising a rod elongated member, wherein the rod elongated member comprises an imprinted surface;

a ring comprising an annular member extending between an outer periphery and an inner periphery forming a ring cavity, wherein a first rod end of the rod elongated member is attached to the annular body on the outer periphery, wherein the ring comprises a threaded cavity disposed on the annular member; and a fastener comprising a threaded member and a knob disposed on a first fastener end of the threaded member, wherein the threaded member is threadedly coupled with the threaded cavity;

an arbor detachably coupled with the centering component, wherein the arbor comprises an arbor elongated member, wherein the ring cavity is configured for receiving the arbor elongated member, wherein an arbor longitudinal axis of the arbor elongated member is perpendicular to a rod longitudinal axis of the rod elongated member, wherein at least on end of the arbor elongated member is configured to be inserted in the bore, wherein the ring is configured to rotate in relation to the bore allowing the centering rod to be angularly displaced around a bore axis corresponding to the bore;

a laser barrel comprising a cylindrical member, wherein the twist-in scope ring of a ring circumference is configured for encompassing the cylindrical member circumferentially, wherein the laser barrel comprises a barrel cavity disposed in the cylindrical member, wherein the barrel cavity is concentric with the cylindrical member, wherein the barrel cavity comprises a cavity opening disposed on a circular surface of the cylindrical member; and a laser pointer disposed in the barrel cavity, wherein the laser pointer is configured for emitting a laser beam.

20. The kit of claim 19, wherein the laser barrel comprises a plurality of cylindrical members corresponding to a plurality of twist-in scope rings, wherein each cylindrical member is characterized by a cylindrical member circumference, wherein a first cylindrical member of a first circumference is attached to a second cylindrical member of a second circumference concentrically, wherein a first twist-in scope ring is configured to receive the first cylindrical member and a second twist-in scope ring is configured to receive the second cylindrical member.

* * * * *